US008978921B2

(12) United States Patent
Orgeldinger

(10) Patent No.: US 8,978,921 B2
(45) Date of Patent: Mar. 17, 2015

(54) CRATE

(75) Inventor: Wolfgang Orgeldinger, Pullach (DE)

(73) Assignee: IFCO Systems GmbH, Pullach (DE)

( * ) Notice: Subject to any disclaimer, the term of this patent is extended or adjusted under 35 U.S.C. 154(b) by 238 days.

(21) Appl. No.: 12/749,716

(22) Filed: Mar. 30, 2010

(65) Prior Publication Data

US 2011/0240659 A1 Oct. 6, 2011

(51) Int. Cl.

| | |
|---|---|
| ***B65D 6/28*** | (2006.01) |
| ***B65D 8/04*** | (2006.01) |
| ***B65D 8/06*** | (2006.01) |
| ***B65D 6/18*** | (2006.01) |

(52) U.S. Cl.

CPC ..... *B65D 11/1846* (2013.01)
USPC ..... 220/608; 206/503; 206/504; 220/600

(58) Field of Classification Search

USPC ..... 206/608, 503, 504; 220/6, 7, 608, 600, 220/623, 23.2, 23.6
See application file for complete search history.

(56) References Cited

U.S. PATENT DOCUMENTS

| | | | | |
|---|---|---|---|---|
| 4,911,303 | A | 3/1990 | Andersson | |
| 5,469,986 | A | 11/1995 | Jang | |
| 5,735,431 | A * | 4/1998 | LeTrudet | 220/639 |
| 6,073,790 | A | 6/2000 | Umiker | |
| 6,098,827 | A | 8/2000 | Overholt et al. | |
| 6,386,388 | B1 * | 5/2002 | Overholt | 220/608 |
| 6,953,116 | B2 * | 10/2005 | Verna et al. | 206/507 |
| 7,007,802 | B1 | 3/2006 | Moorman et al. | |
| 7,017,765 | B2 * | 3/2006 | Overholt | 220/6 |
| 2002/0148842 | A1 | 10/2002 | Overholt et al. | |
| 2002/0158067 | A1 * | 10/2002 | Overholt et al. | 220/6 |
| 2003/0052133 | A1 * | 3/2003 | Hayes et al. | 220/835 |
| 2003/0146213 | A1 * | 8/2003 | Kellerer et al. | 220/7 |
| 2006/0118450 | A1 * | 6/2006 | Stahl | 206/506 |
| 2009/0261091 | A1 | 10/2009 | Dobson | |
| 2009/0261092 | A1 | 10/2009 | Blanchard | |

FOREIGN PATENT DOCUMENTS

| | | | |
|---|---|---|---|
| CN | 2071431 | U | 2/1991 |
| CN | 1106355 | A | 8/1995 |
| CN | 1284924 | A | 2/2001 |
| CN | 2823131 | Y | 10/2006 |
| CN | 2908370 | Y | 6/2007 |
| DE | 10 2006 005 873 | A1 | 8/2007 |
| EP | 0 417 947 | B1 | 7/1994 |
| GB | 1 323 289 | A | 7/1973 |
| JP | 62-078054 | A | 4/1987 |
| JP | 63-096037 | A | 4/1988 |
| JP | 09-207937 | A | 8/1997 |

(Continued)

OTHER PUBLICATIONS

Official Communication issued in corresponding European Patent Application No. 10158400.1, mailed on Oct. 8, 2010.

(Continued)

*Primary Examiner* — Luan K Bui
*Assistant Examiner* — Rafael Ortiz
(74) *Attorney, Agent, or Firm* — Keating & Bennett, LLP

(57) ABSTRACT

A crate comprises a bottom and two respective pairwise opposing side walls and end walls, wherein the bottom is arch-shaped curving towards the interior of the crate, such that a space between a lower surface of the bottom and a plane defined by a lower end of the crate is provided.

5 Claims, 21 Drawing Sheets

(56) References Cited

FOREIGN PATENT DOCUMENTS

| | | | |
|---|---|---|---|
| JP | 11-034568 | A | 2/1999 |
| JP | 11-124138 | A | 5/1999 |
| JP | 2001-058685 | A | 3/2001 |
| JP | 2001-206471 | A | 7/2001 |
| JP | 2002-037252 | A | 2/2002 |
| JP | 2003-026270 | A | 1/2003 |
| JP | 2003-518471 | A | 6/2003 |
| JP | 2003-267361 | A | 9/2003 |
| JP | 2004-509029 | A | 3/2004 |

OTHER PUBLICATIONS

Orgeldinger; "Crate"; U.S. Appl. No. 12/749,713, filed Mar. 30, 2010.
Orgeldinger; "Crate"; U.S. Appl. No. 12/749,717, filed Mar. 30, 2010.
Orgeldinger; "Crate"; U.S. Appl. No. 12/749,722, filed Mar. 30, 2010.
Orgeldinger; "Banana Crate"; U.S. Appl. No. 29/358,597, filed Mar. 30, 2010.
English translation of Official Communication issued in corresponding Japanese Patent Application No. 2013-501775A, mailed on Jan. 7, 2014.
English translation of Official Communication issued in corresponding Ukrainian Patent Application No. a201211285, mailed on Nov. 19, 2013.
Official Communication issued in corresponding Japanese Patent Application No. 2013-501774, mailed on Dec. 10, 2013.
Official Communication issued in corresponding Japanese Patent Application No. 2013-501773, mailed on Dec. 10, 2013.
Official Communication issued in corresponding Chinese Patent Application No. 201180018120.9, mailed on Apr. 1, 2014.
English translation of Official Communication issued in corresponding Chinese Patent Application No. 201180018126.6, mailed on Apr. 2, 2014.
English translation of Official Communication issued in corresponding Chinese Patent Application No. 201180018122.8, mailed on Apr. 1, 2014.

* cited by examiner

CRATE

The present invention relates to a crate for accommodating products such as fruits and vegetables, and in particular, to a banana crate.

Crates for storing and transporting products such as fruits and vegetables are widely used in the market. Normally, such crates are light and stable, which makes them suitable for bringing the crops from the field to the customer. Especially for tropical fruits like bananas, it is common to harvest the crop while it is still unripe and pack it into the crates for subsequent shipping and transportation. On their journey, the fruits have time to ripe. Before the transport, the crates are usually stacked on top of each other and arranged side by side onto pallets. Here, often a specific crosstacking technique is used such as in case of a "five-down configuration". In this five-down configuration, five crates are arranged adjacent to each other into a rectangular array, such that two of them form a row in the length direction and the other three form a row in the width direction.

However, one problem is that in such a configuration, a free and uniform air circulation between a short side (end wall) and a long side (side wall) of adjacent crates according to the prior art is not guaranteed. This is disadvantageous in that the fruits may not receive uniform temperature control during their transport and storage as a result of uneven distribution of air.

Another disadvantage of known crates is that the inner surfaces of their side walls are straight, very uneven and may comprise sharp and/or hard objects such as corners or edges. Therefore, especially products having rounded surface portions such as bananas, apples or oranges may easily be damaged by such raw surfaces.

Moreover, for the purpose of quality control, it may be required that a controller can have quick and easy access to the inside of a specific crate, when this crate (not the uppermost) is arranged in a stack of a plurality of crates. However, known crates do not offer this possibility, meaning that the controller has to partially disassemble and reassemble the stack, when taking a look into the interior of a specific crate is required. This procedure is inefficient and also not convenient, thereby representing a further disadvantage.

Finally, a further disadvantage associated with known open-top crates is that in case of stacking two of them on top of each other, products slightly sticking out beyond the upper end of the lower crate (e.g. curved portions of a banana) may be contacted by a load of the upper crate, eventually leading to a damage of the product.

It is therefore an object of the present invention to provide a crate allowing for an improved airflow, packaging, access for inspection, and stacking of transportable products.

SUMMARY OF THE INVENTION

According to an embodiment of the present invention, the crate comprises a bottom and two respective pairwise opposing side walls and end walls, each side wall comprising a plurality of vent holes in a region A extending along a horizontal direction of the side wall, and each end wall comprising a grip hole. Here, the region A is the distance $d_A$ away from a corner of the crate, the distance $d_A$ being equal to the distance $d_{GH}$ the grip hole is away from the same corner of the crate. Furthermore, a height $h_A$ of the region A is substantially equal to the height $h_{GH}$ of the grip hole, i.e. the heights are such that same overlap at least partially in the height direction.

This insures a venting path for providing an optimum air flow between adjacent crates, which are, for example, arranged in the five-down configuration. Consequently, by this venting path, a fast and especially uniform airflow can be achieved, resulting in consistent temperature control for fruit quality.

According to embodiments, the plurality of vent holes may comprise a pair of vent holes having a combined shape similar to the grip hole. The plurality of vent holes may be spaced with a distance being less than a dimension of the grip hole. A vent hole of the plurality of vent holes may comprise a horizontal dimension being less than the dimension of the grip hole. The side walls and the end walls may be configured to be foldable with respect to the bottom, such that, in a folded state, a remaining volume of the crate is minimal. The bottom may comprise two pairs of ventilation openings, wherein each ventilation opening of the first pair has a width equal or larger than 40 mm and a length equal or larger than 126 mm, and wherein each ventilation opening of the second pair has a width equal or larger than 40 mm and a length equal or larger than 25 mm. Each vent hole of the plurality of vent holes may have a width equal or larger than 20 mm and a length equal or larger than 24 mm. Each grip hole may have a width equal or larger than 30 mm and a length equal or larger than 100 mm.

Embodiments of the invention concerns an arrangement of two crates according to embodiments of the invention, wherein the crates are arranged such that an end wall of a first crate is adjacent to a side wall of a second crate, wherein the first crate is configured to be aligned along a first longitudinal axis parallel to a side wall of the first crate, and wherein the second crate is configured to be aligned along a second longitudinal axis parallel to a side wall of the second crate, the first longitudinal axis and the second longitudinal axis being perpendicular to each other, wherein a side wall of the first crate and an end wall of the second crate are aligned, such that at least a partial overlap of the grip hole of the first crate and at least one vent hole of the plurality of vent holes of the second crate is provided, such that a venting path between the first crate and the second crate is provided. The plurality of crates may be configured as a five-down configuration, such that a venting path between adjacent crates is provided.

According to a further embodiment, each side wall comprises a smooth inner surface being shaped in a convex form towards the outside of the crate, thereby providing an inner surface for accommodating products having rounded surface portions and avoiding damage of the products. The side walls and end walls may comprise stiffening members, which are provided on a respective outer surface of the side walls and end walls only. The side walls and the end walls may be made of plastic to provide the smooth inner surface (810). The convex-shaped smooth inner surface may have a lateral curvature dimension less than a maximum lateral dimension of the side wall, wherein the inner surface is substantially curved in a region of the side wall only, where non-continuous stiffening member extending along a vertical direction of the side wall are interrupted, and wherein the region is a central region According to a another embodiment, at least one end wall comprises a thinned portion, wherein the thinned portion is adapted to allow the user to cut the end wall for providing an inspection opening. The thinned portion of the end wall may be a groove surrounding a predefined area of the end wall, wherein the groove comprises a thickness more than half of the thickness of the end wall. The end wall (130) may further comprises a plurality of holes being arranged along the groove, each hole having a diameter larger than a width of the groove. The thinned portion may be configured to provide an openable portion hingedly attached to the end wall, when the thinned portion is cut by the user, wherein the predefined area is substantially rectangular, and wherein the groove is adjacent to at least three sides of the predefined area. The predefined area may be more than one third of an area of the end wall. The end wall (130) may be made of plastic. An arrangement of a plurality of crates according the according to embodiments of the invention may have the plurality of crates arranged adjacent to each other, such that at least one end wall comprising the thinned portion is accessible by the user.

According to a yet another embodiment, the bottom is arch-shaped curving towards the interior of the crate, such that a space S between a lower surface of the bottom and a plane P defined by a lower end of the crate is provided. This, essentially, allows to stack two crates on top of each other without squeezing or damaging products protruding from the lower crate into the space S. The bottom may be arch-shaped along a direction of an end wall or along a direction of a side wall of the crate. The bottom may be wavy-shaped along a direction of the side wall in a border region of the side wall, a first portion of the wavy-shaped bottom may be at a height of the plane, and a second portion of the wavy-shaped portion may be maximally at a height of a lower end of the upper portion. The bottom may comprises an upper portion and a lower portion recessed with respect to the outer point of the walls, and a distance of the recess may be equal to a thickness of the walls, allowing for engagement of the lower portion with a top opening of a further crate. The lower portion may have an area defined by an outer perimeter of the lower portion, and the upper portion may have an area defined by an outer perimeter of the upper portion, the side walls and end walls may comprise inner surfaces and outer surfaces, wherein an inner area may be defined by the inner surfaces at a upper end of the crate, and wherein an outer area may be defined by the outer surfaces at the upper end of the crate, wherein the area may be approximately equal the area and the area may be approximately equals the area. Embodiments define a stack of two crates according to the invention wherein a first crate and a second crate are configured to provide an inner area defined by the inner surfaces at an upper end of the first crate and an area defined by an outer perimeter of the lower portion of the second crate, wherein the area and the area are equal, such that the movement between the first crate and the second crate is prevented, when the second crate is stacked on top of the first crate. The bottom of the second crate may comprise a plurality of vent openings being configured to provide a venting path between the first crate and the second crate.

Other elements, features, steps, characteristics and advantages of the present invention will become more apparent from the following detailed description of the preferred embodiments with reference to the attached drawings.

BRIEF DESCRIPTION OF THE DRAWINGS

In the following, embodiments of the present invention will be explained with reference to the accompanying drawings, in which.

DESCRIPTION OF EMBODIMENTS OF THE INVENTION

Figure 1:
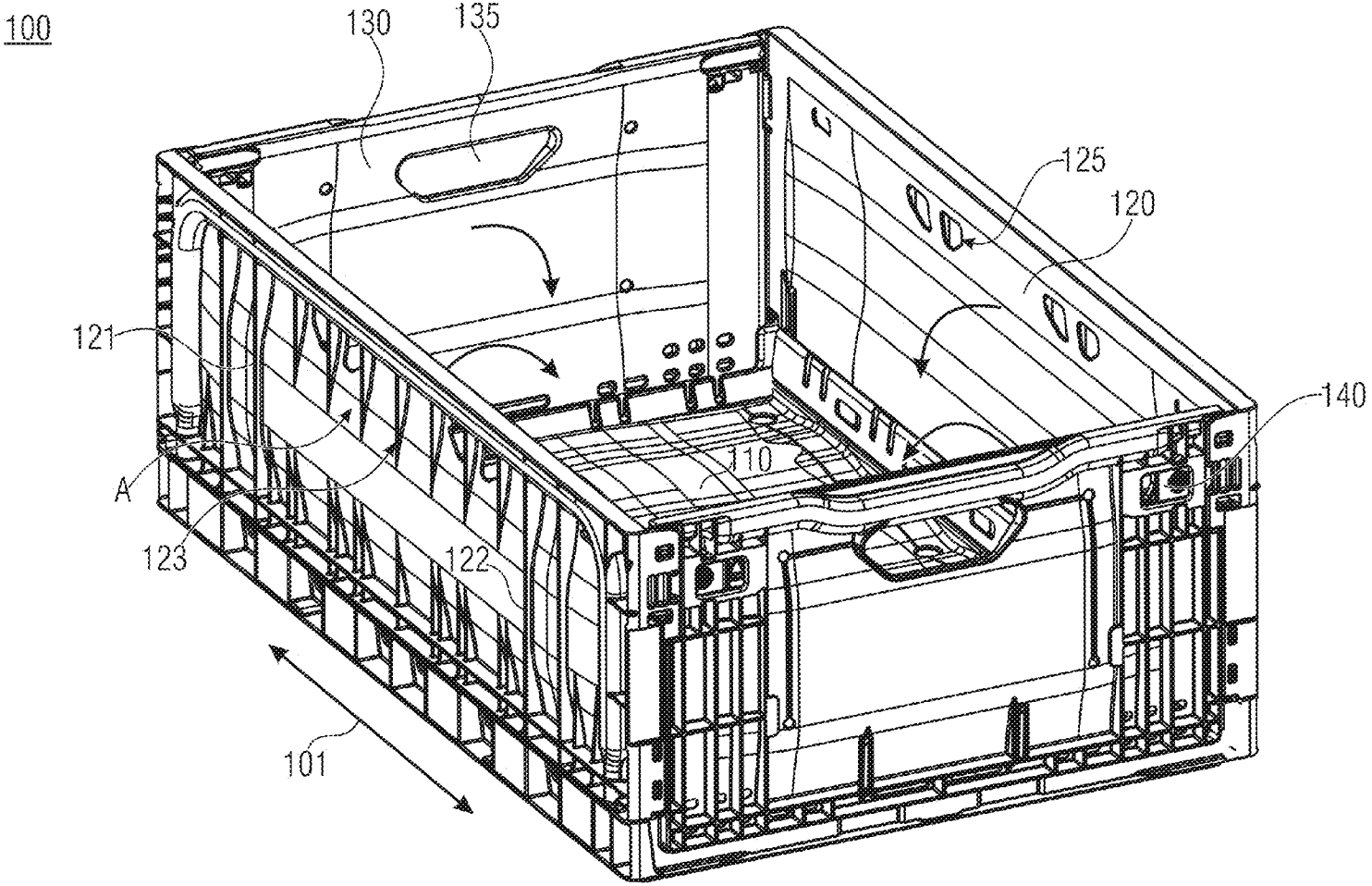
FIG. 1 shows a perspective view of an embodiment of a crate.

FIG. 1 shows a perspective view of an embodiment of a crate 100. The crate 100 comprises a bottom 110 and two respective pairwise opposing side walls 120 and end walls 130. Referring to FIG. 1, the side wall 120 has a larger extent than the end wall 130. Both the side walls 120 and the end walls 130 are foldable with respect to the bottom 110. In particular, the side walls 120 and the end walls 130 are attached to the bottom 110 such that they can be folded onto it in the directions of the arrows, as shown in FIG. 1. In a folded state, the remaining volume of the crate 100 is minimal. This has the advantage that in the folded state, the crate 100 occupies only a low height. Therefore, a large number of empty crates may be stacked onto a pallet for transport.

In embodiments, the crate 100 is made of plastic in order to provide a low weight and a high stability for storage and/or transport applications.

As shown in FIG. 1, each side wall 120 comprises a plurality 125 of vent holes, while each end wall 130 comprises a grip hole 135. The plurality 125 of vent holes is essentially located in a region A extending along a horizontal direction 101 of the side wall 120. Here, the horizontal direction is defined as a direction along a longer side of a respective side wall. Moreover, the region A is essentially defined as a region surrounded by two continuous stiffening members 121, 122 in the vicinity of the upper end of the crate 100, where a plurality 123 of non-continuous stiffening members is not interrupted. It can also be seen in FIG. 1 that the side walls 120 and the end walls 130 may be fastened to each other by using a fastener 140, when the crate 100 is in its unfolded state.

Figure 2:
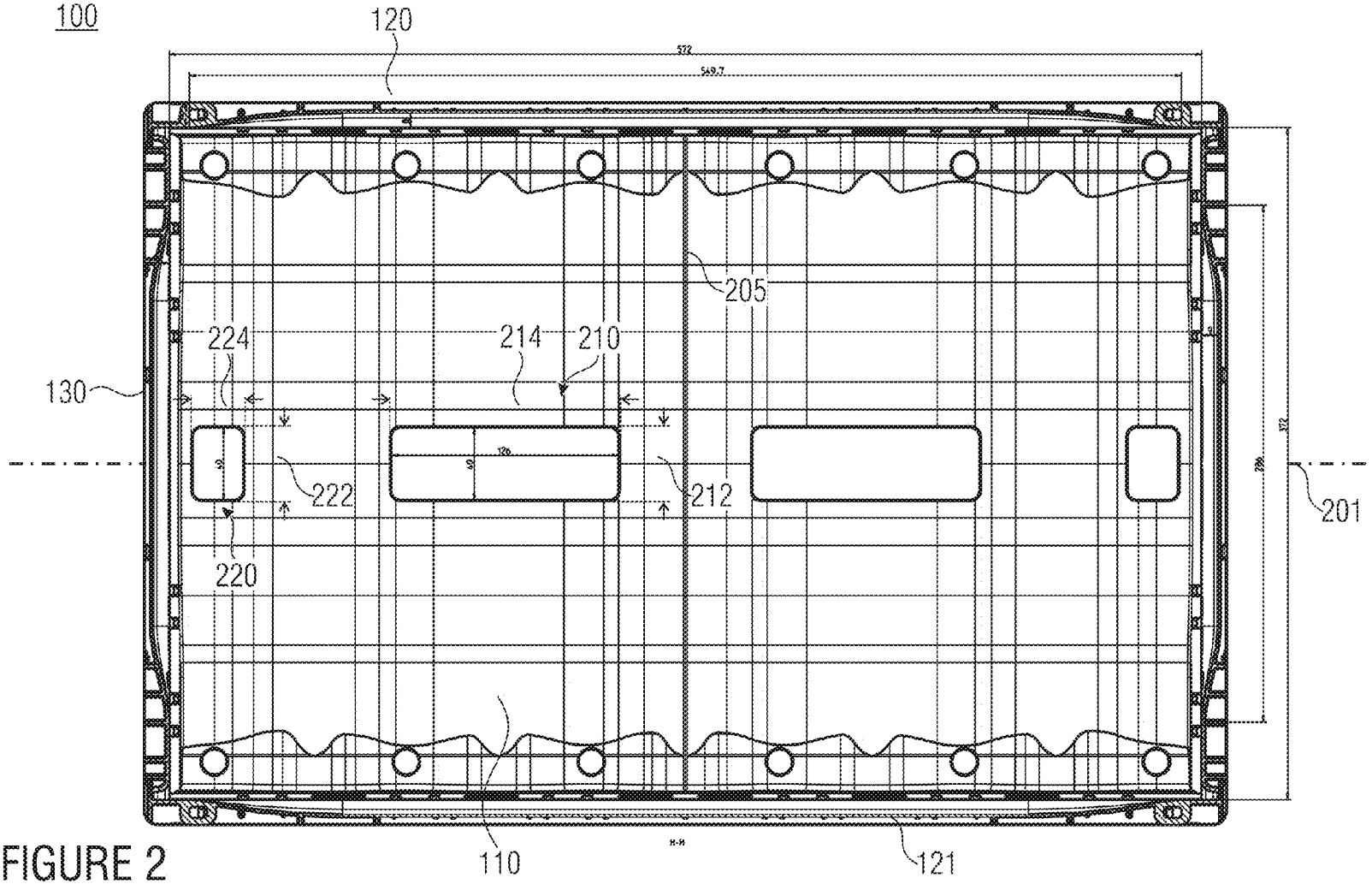
FIG. 2 shows a top view of the embodiment of the crate in accordance with FIG. 1.

FIG. 2 shows a top view of the embodiment of the crate 100 in accordance with FIG. 1. In particular, the bottom 110 may comprise two pairs 210, 220 of ventilation openings, which may be symmetrically arranged with respect to an axis 205 parallel to the end wall 130 along a central longitudinal axis 201. Specifically, each ventilation opening of the first pair 210 may have a width 212 equal or larger than 40 mm and a length 214 equal or larger than 126 mm, while each ventilation opening of the second pair 220 may have a width 222 equal or larger than 40 mm and a length 224 equal or larger than 25 mm. Here, the width is defined as a dimension parallel to the end wall 130, while the length is defined as the dimension parallel to the side wall 120. The two pairs 210, 220 of ventilation openings should be dimensioned such that they are large enough to provide a proper venting through the bottom 110. However, they may not be chosen so large that specific products will fall out of the crate 100. As can already be seen in FIG. 2, an inner surface 121 of the side wall 120 is configured to be bent towards the outside of the crate 100, which will be described in detail later on.

Figure 3:
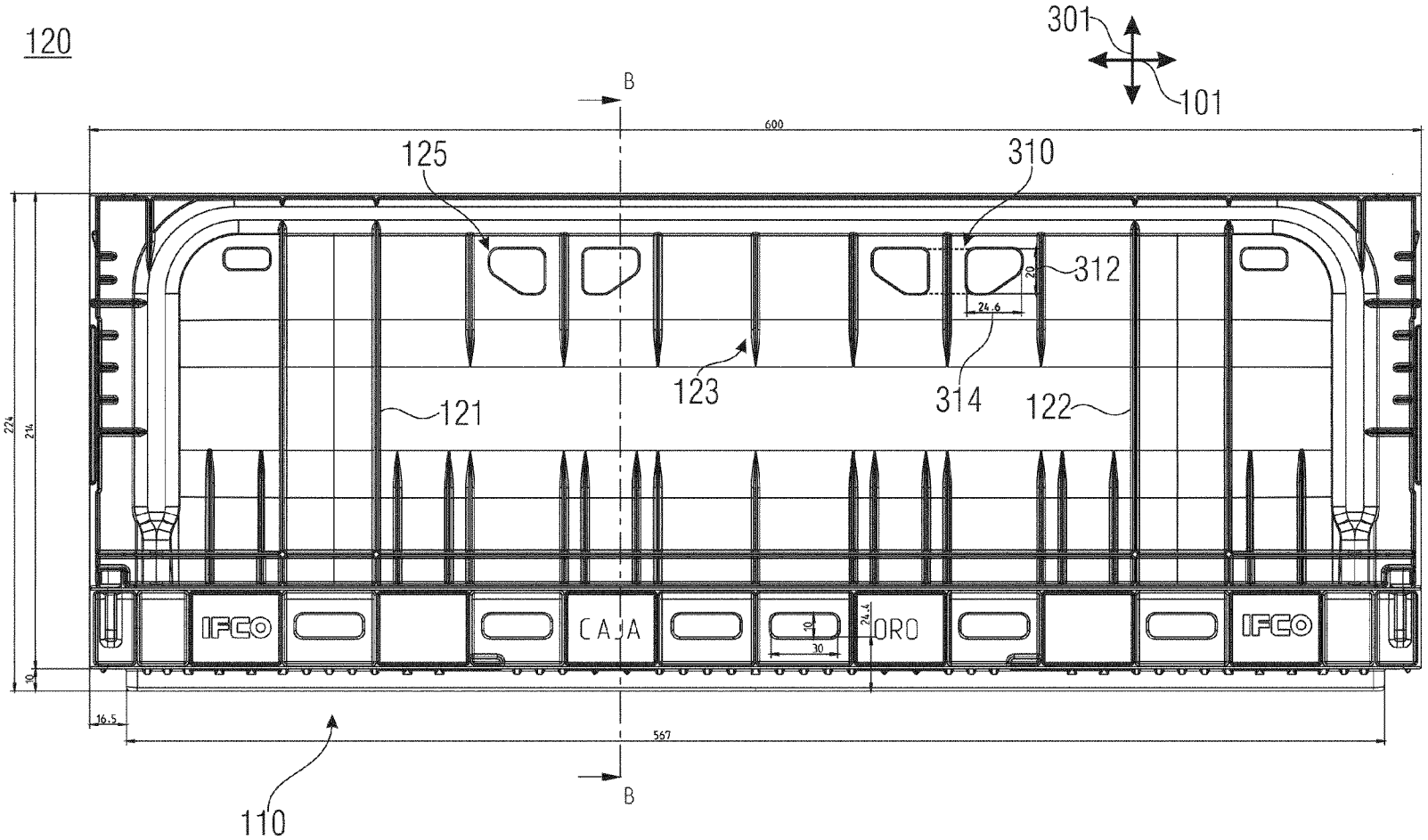
FIG. 3 shows a side view of a side wall of the embodiment of the crate in accordance with FIG. 1.

FIG. 3 shows a side view of a side wall 120 of the embodiment of the crate 100 in accordance with FIG. 1. In the FIG. 3 view, the plurality 125 of vent holes can be clearly seen. In particular, the plurality 125 of vent holes may comprise a pair 310 of vent holes. Together, these vent holes may have a combined shape similar to that of the grip hole 135 (comp. FIG. 1). This is advantageous because by adapting the combined shape, it is possible to achieve an optimum overlap of the pair 310 of vent holes and the grip hole 135, when, for example, two crates are arranged in a five-down configuration. With regard to FIG. 3, each vent hole of the plurality 125 of vent holes may have a width 312 equal or larger than 20 mm and a length 314 equal or larger than 24 mm. Here, the width is defined as a dimension in a vertical direction 301 of the side wall 120, while the length is defined as a dimension in the horizontal direction 101 of the side wall 120. Moreover, the continuous stiffening members 121, 122 and the plurality 123 of non-continuous stiffening members extending in the vertical direction 101 of the side wall 120 are clearly seen in FIG. 3.

Figure 4:
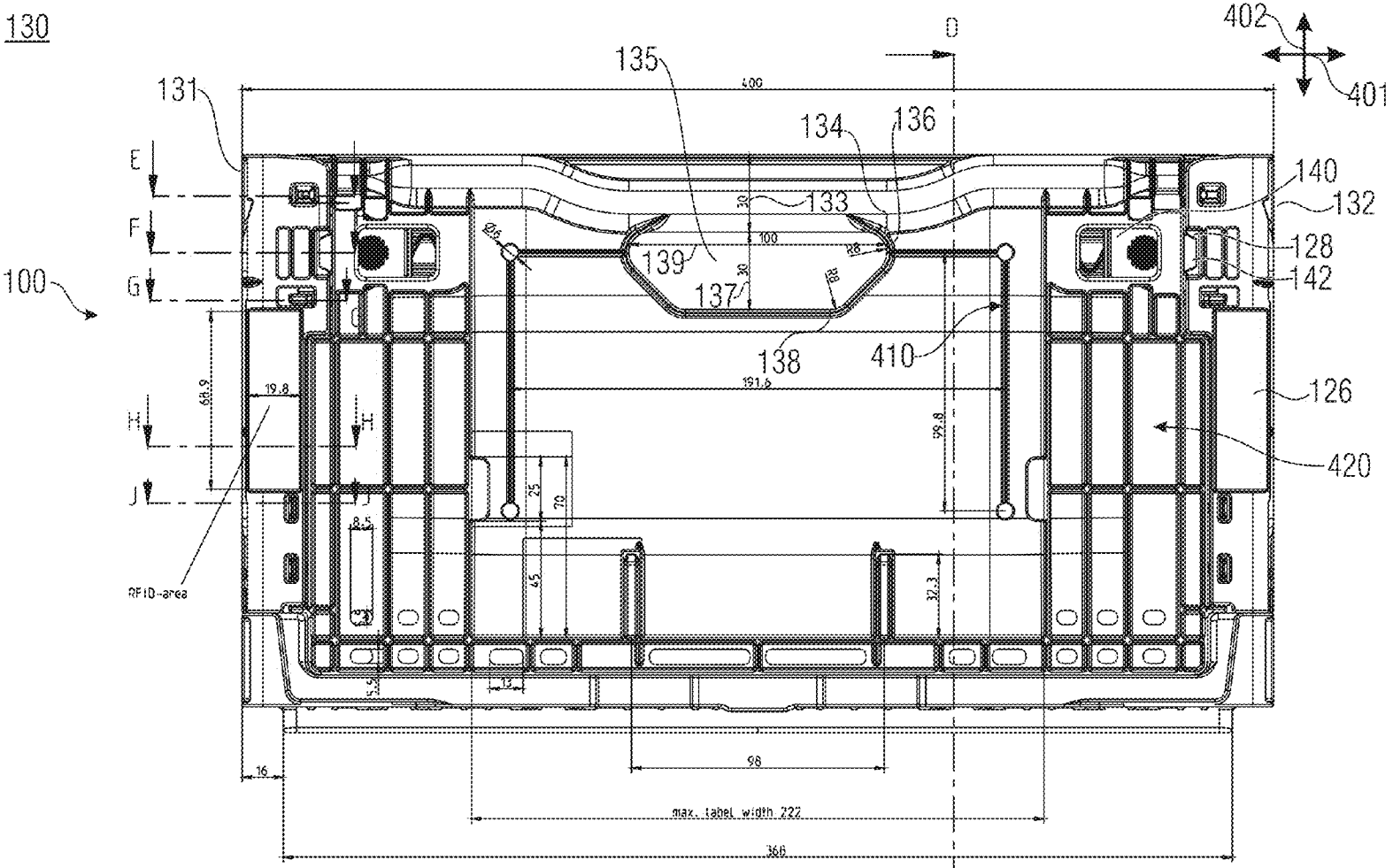
FIG. 4 shows a side view of an end wall of the embodiment of the crate in accordance with FIG. 1.

FIG. 4 shows a side view of an end wall 130 of the embodiment of the crate 100 in accordance with FIG. 1. As can be seen in FIG. 4, the grip hole 135 is centered with respect to two edges 131, 132, of the crate 100. The grip hole 135 is also recessed with respect to an upper end of the crate 100 by a distance 133 of about 30 mm. In particular, by joining the grip hole 135 to a thickened upper frame portion 134 of the end wall 130, a strong grip may be provided for carrying a loaded crate 100. Referring to FIG. 4, the grip hole 135 may have a width 137 equal or larger than 30 mm and a length 139 equal or larger than 100 mm. Here, the width is defined as the dimension in a vertical direction 402 of the end wall 130, while the length is defined as the dimension in a horizontal direction 401 of the end wall 130. It can also be seen that the grip hole 135 tapers from a maximum horizontal extension at an upper point 136 to a minimum horizontal extension at a lower point 138, thereby providing an ergonomic grip. The fastener 140 is also clearly visible in FIG. 4. The fastener 140 may be attached to the end wall 130 in that it can engage with the recess 128 provided in a portion 126 of the side wall 120. Here, the fastening mechanism may work on the basis that a displacement element 142 of the fastener 140 can be displaced against the force of a spring element. Additionally, as already indicated in FIG. 4, the end wall 130 may comprise a thinned portion 410 essentially surrounding a central portion of the end wall 130 including a part of the grip hole 135. The purpose and more details regarding the thinned portion 410 will be described later. A further characteristic feature of the end wall 130 is that a plurality 420 of stiffening members may be provided close to a border region of the end wall 130. This provides an increased ability supporting the above-mentioned fastening mechanism.

Arrangement of the Vent Holes ($1^{st}$ Aspect)

A first aspect of the present invention addresses the disadvantage that in a five-down configuration, for example, a uniform air flow is not provided between adjacent crates according to the prior art.

Figure 5:
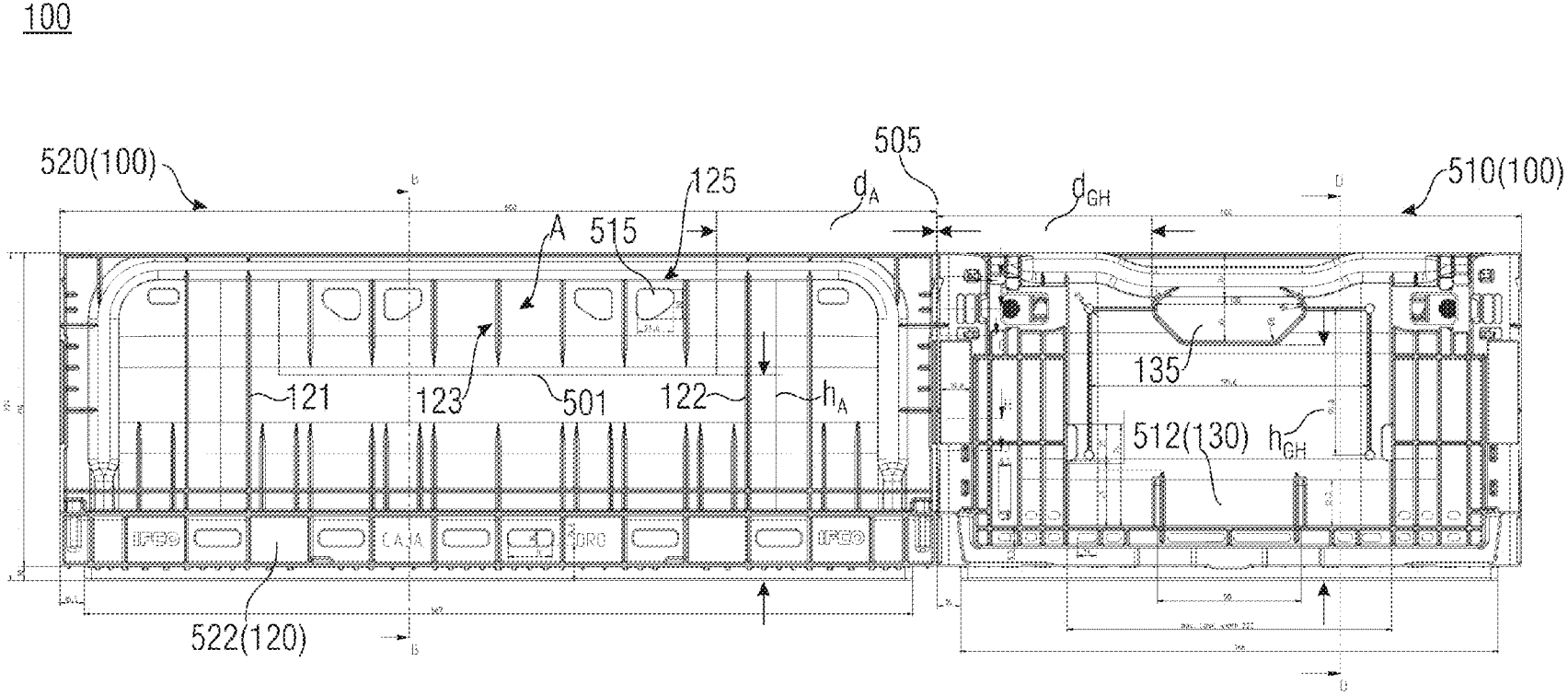
FIG. 5 shows a side view of the end wall and the side wall of the crate in accordance with FIG. 1 mentally unfold at a corner of the same.

FIG. 5 depicts the end wall 130 and the side wall 120 of the crate 100 mentally unfold at the same corner 505 of the crate 100. Alternatively, FIG. 5 may also illustrate an end wall 512 of a first crate 510 adjacent to a side wall 522 of a second crate 520, wherein the first crate 510 is aligned with the second crate 520 at the corner 505. As depicted, the side wall 120 of the crate 100, or alternatively, the side wall 522 of the second crate 520 comprises the plurality 125 of vent holes in a region A. The region A is indicated in FIG. 5 by a dashed line 501. In embodiments, the region A is a distance $d_A$ away from the corner 505 and has a height $h_A$. Furthermore, the end wall 130, or alternatively, the end wall 512 of the first crate 510 comprises the grip hole 135. In embodiments, the grip hole 135 is a distance $d_{GH}$ away from the same corner 505 and has a height $h_{GH}$. It can be seen in the FIG. 5 embodiment that the distance $d_A$ is approximately equal to the distance $d_{GH}$ and the height $h_A$ is approximately equal to the height $h_{GH}$. Therefore, especially in the five-down configuration (see FIGS. 7*a*, 7*b*, 8*a*; 8*b*), at least a partial overlap of the grip hole 135 of the first crate 510 and at least one vent hole (e.g. vent hole 515) of the second crate 520 may be provided, and consequently, venting paths between the two crates 510, 520 will be obtained.

Figure 6:
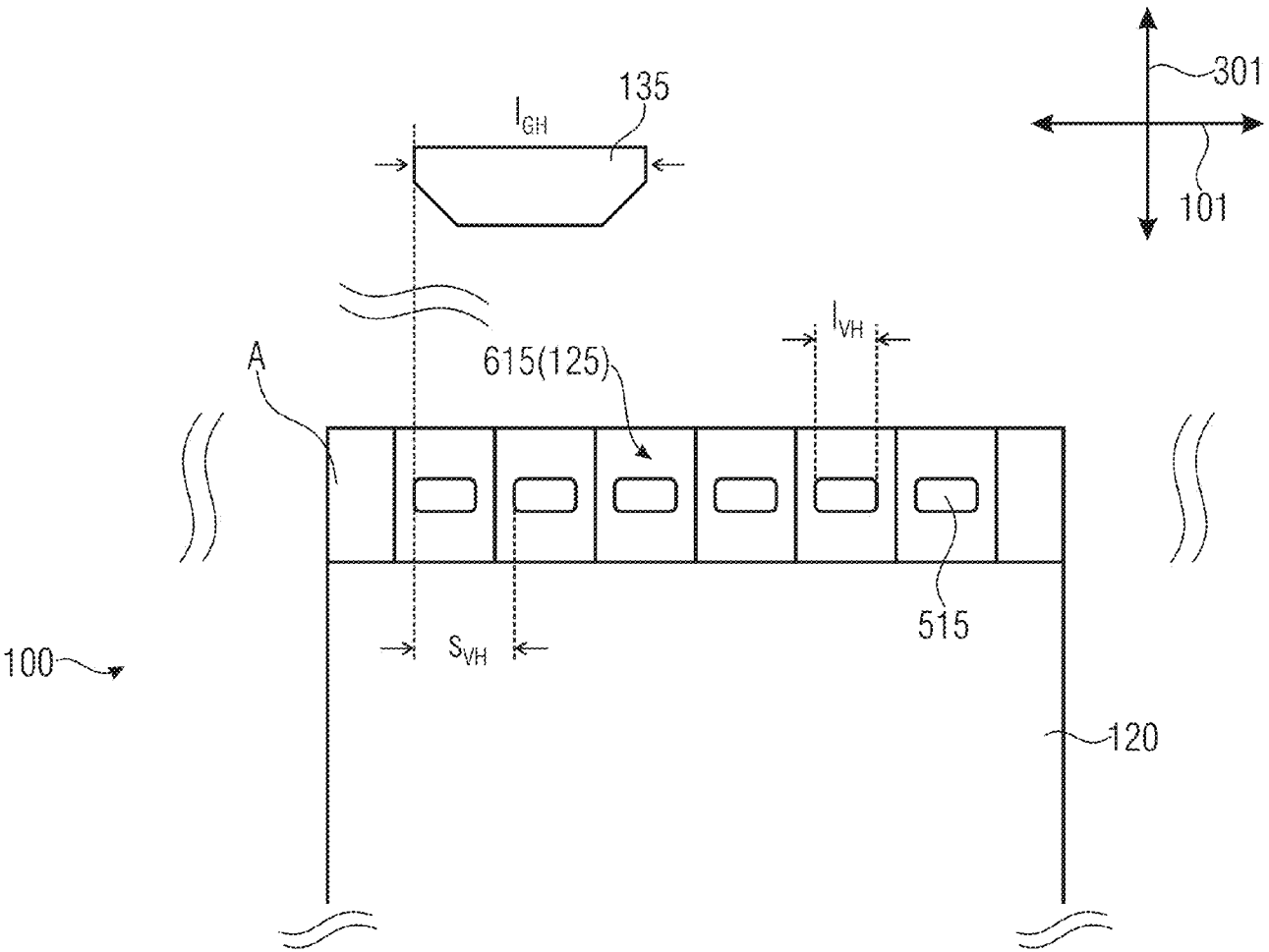
FIG. 6 illustrates dimensions of a plurality of vent holes and a grip hole according to a further embodiment of a crate.

FIG. 6 illustrates dimensions of a plurality 615 of vent holes and a grip hole 135 according to a further embodiment of the crate 100. The plurality 615 of vent holes shown in FIG. 6 may correspond to the plurality 125 of vent holes shown in FIG. 3. In the FIG. 6 embodiment, the plurality 615 of vent holes is spaced along the horizontal direction 101 of the side wall 120 with a distance $s_{VH}$. In addition, each vent hole may have the same extent and may be rectangular-shaped. The distance $s_{VH}$ may be chosen such that it is less than a dimension $l_{GH}$ of the grip hole 135, wherein the dimension $l_{GH}$ may correspond to the maximum horizontal extent 139, as shown in FIG. 4. In addition, the horizontal dimension $l_{VH}$ of a vent hole may be chosen less than the dimension $l_{GH}$ of the grip hole 135. A vertical dimension of the vent hole along the vertical direction 301 may also be less than the vertical extent of the grip hole 135. Therefore, a characteristic dimension of the plurality 615 of vent holes is generally configured to be smaller than that of the grip hole 135, such that an overlap of the at least one vent hole 515 with the grip hole 135 may be provided, such as in case of the five-down configuration.

Figure 7A:
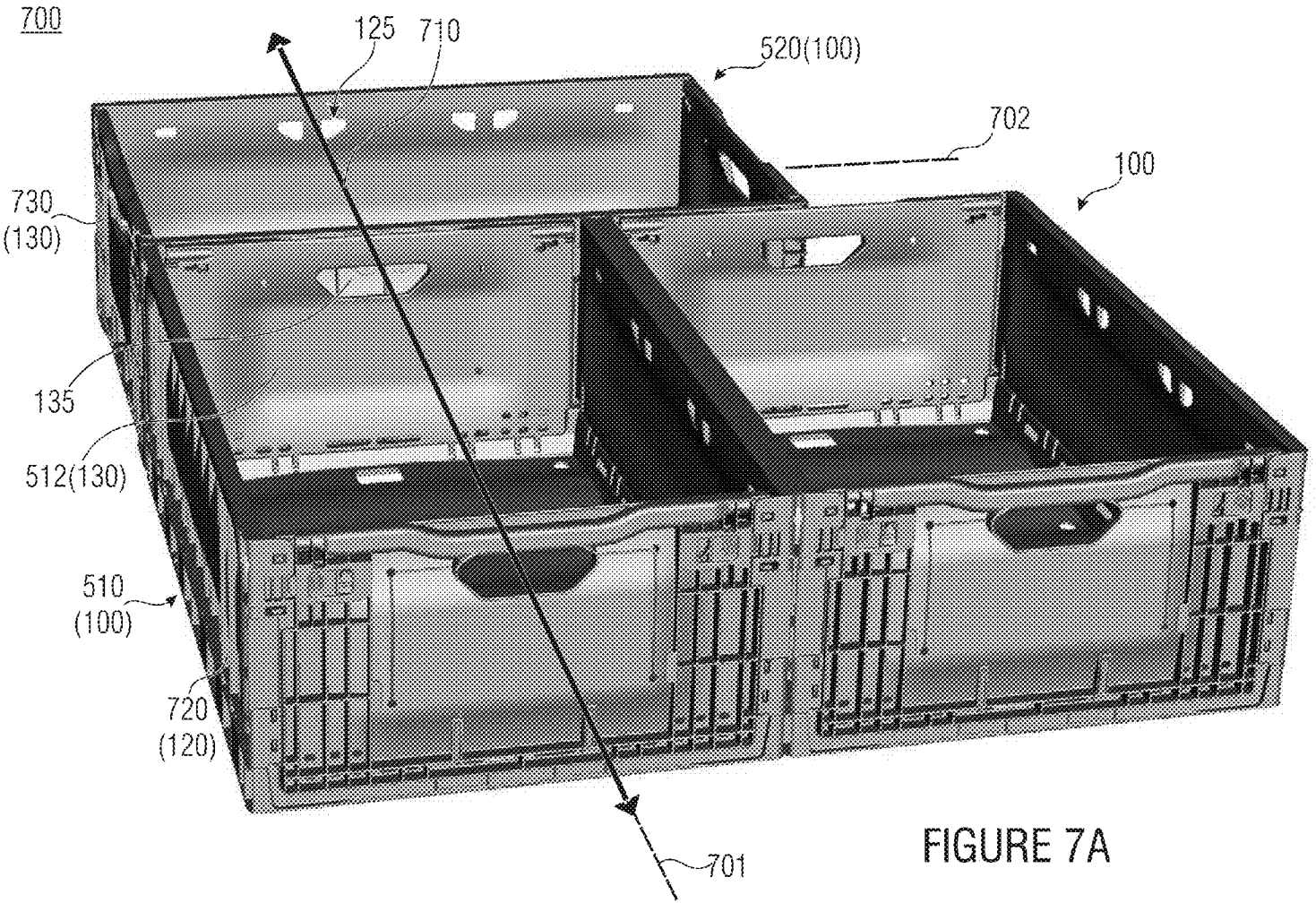
FIGS. 7*a*; 7*b* show a perspective view of an arrangement of a plurality of crates of the embodiment of FIGS. 1 to 5 in the partial five-down configuration.
Figure 7B:
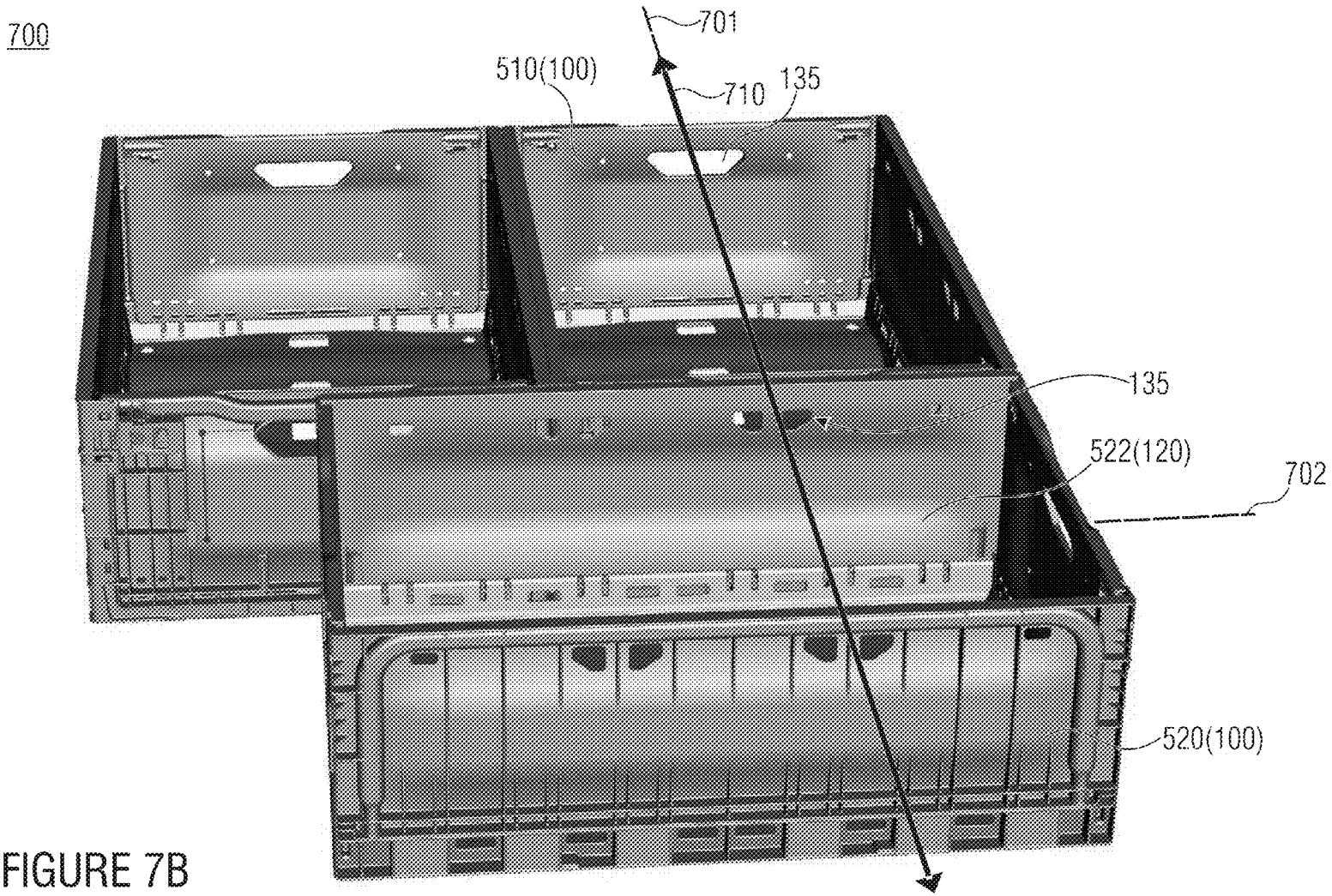
FIG. 7*c* shows a side view of an end wall of a crate of arrangement in accordance with FIGS. 7*a*; 7*b;*
FIG. 7*d* shows a side view of a side wall of a crate of the arrangement in accordance with FIGS. 7*a*; 7*b;*
FIG. 7*e* shows a top view of a crate of the arrangement in accordance with FIGS. 7*a*; 7*b;*

FIGS. 7*a*; 7*b* show a perspective view of an arrangement 700 of a plurality of crates of the embodiment described with respect to FIGS. 1 to 5 in a partial five-down configuration. In this context, 'partial' means that only three instead of five crates 100 of the five-down configuration are shown. Referring to FIGS. 7*a* and 7*b*, the two specific crates 510, 520 are arranged such that the end wall 512 of the first crate 510 is adjacent to the side wall 522 of the second crate 520. Here, the first crate 510 is aligned along a first longitudinal axis 701, while the second crate 520 is aligned along a second longitudinal axis 702. As can be seen in FIGS. 7*a*; 7*b*, the first longitudinal axis 701 and the second longitudinal axis 702 are perpendicular to each other. Moreover, a side wall 720 of the first crate 510, which may correspond to the side wall 120 of FIG. 3, and an end wall 730 of the second crate 520, which may correspond to the end wall 130 of FIG. 4, are aligned to be flush in this partial five-down configuration. Correspondingly, the at least partial overlap of the grip hole 125 of the first crate 510 and the at least one vent hole of the plurality 125 of vent holes of the second crate 520 may be provided. The thus obtained venting path 710, which is indicated by a dark arrow, shows a venting path for the air flow, thereby securing a proper ventilation of the respective interior of the crates 510, 520.

Figure 7C:
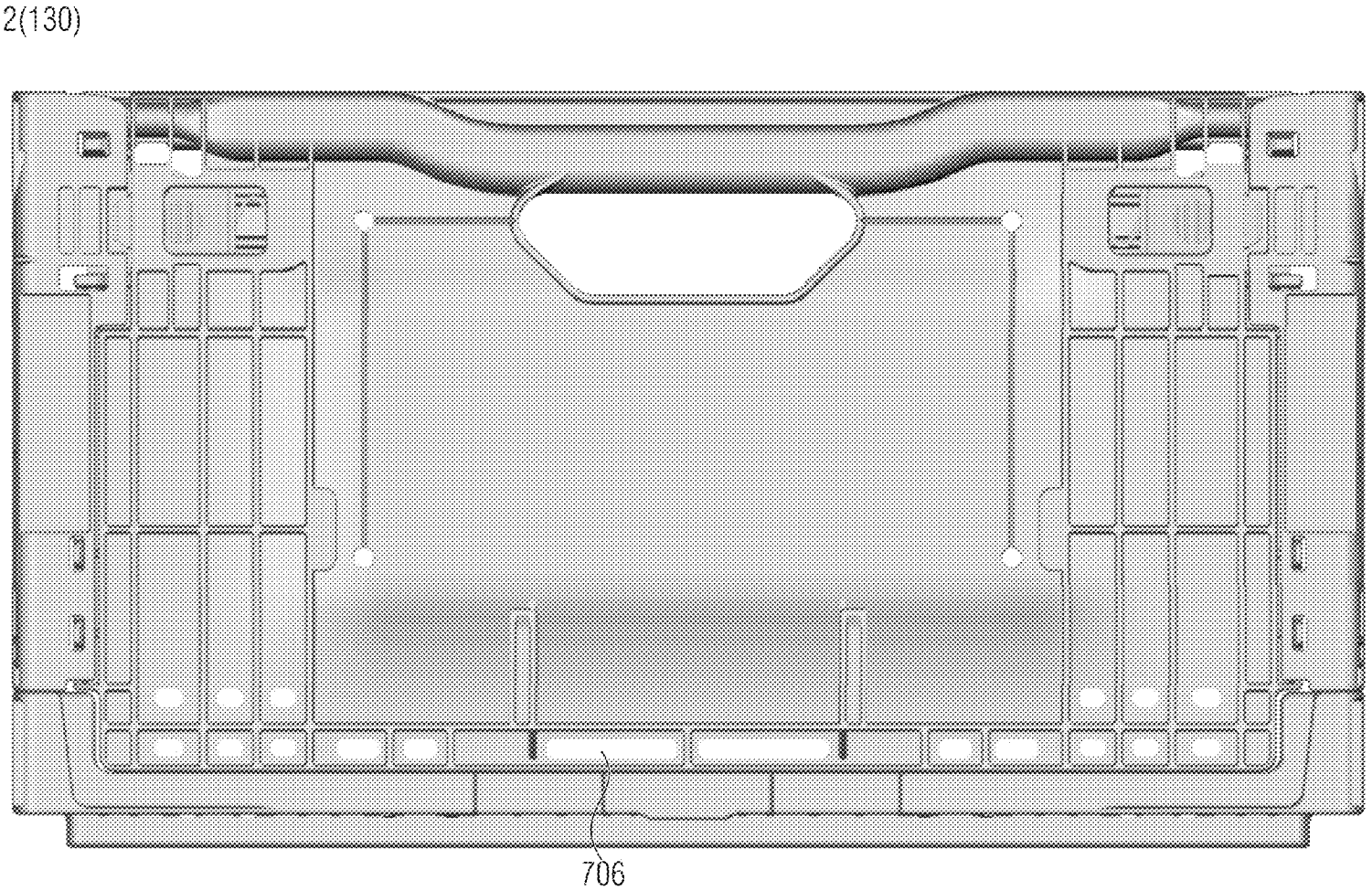
Figure 7D:
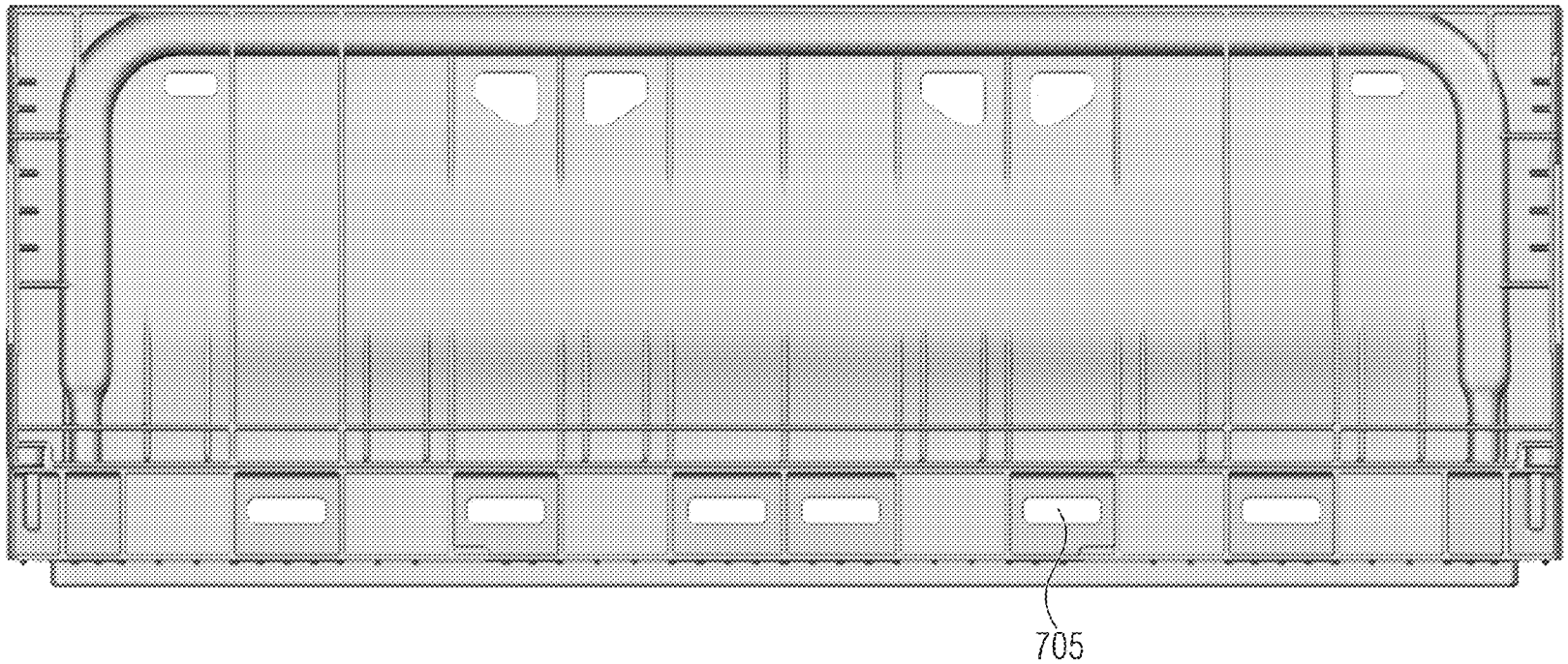
Figure 7E:
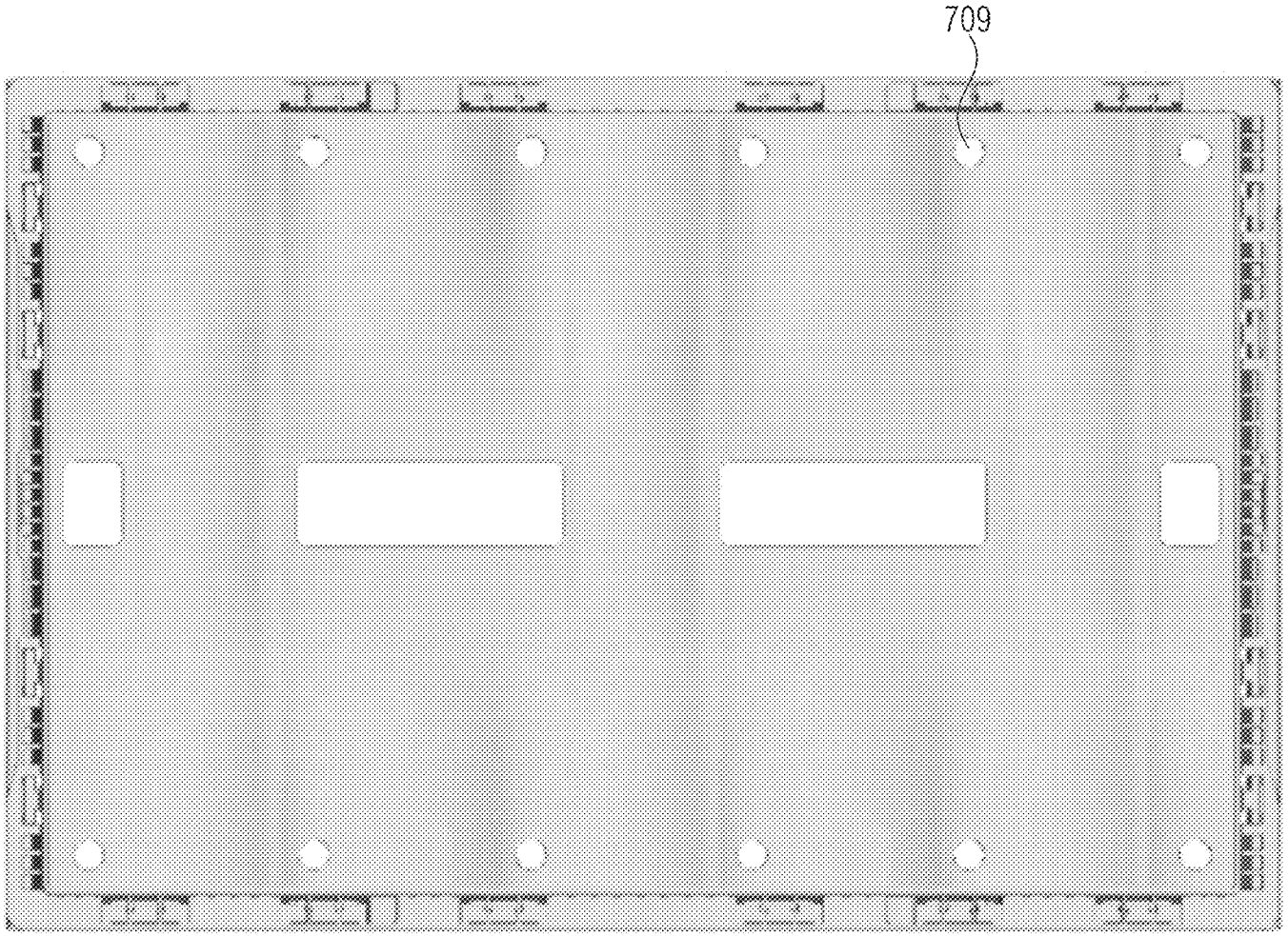

FIGS. 7*c*, 7*d* and 7*e* show different views of the end wall 512, the side wall 522 and the crate 510, respectively. Specifically, in the shown embodiments, further different formations of ventilation regions 705; 706; 709 in the lower part of the crate 510 may be provided, eventually leading to better ventilation properties.

Figure 8A:
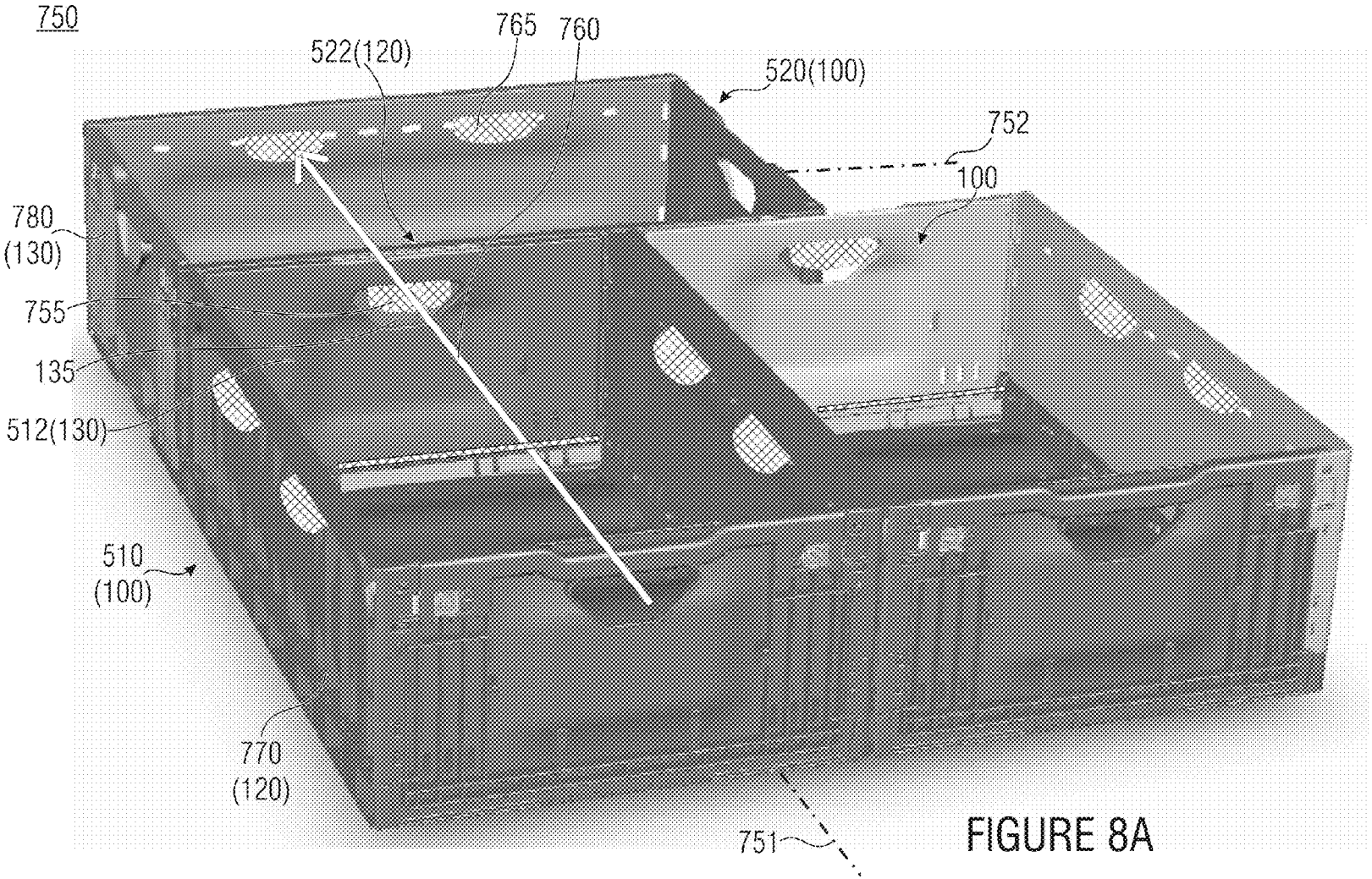
FIGS. 8*a*; 8*b* show a perspective view of an embodiment of a plurality of crates of the embodiment of FIG. 6 in the partial five-down configuration.
Figure 8B:
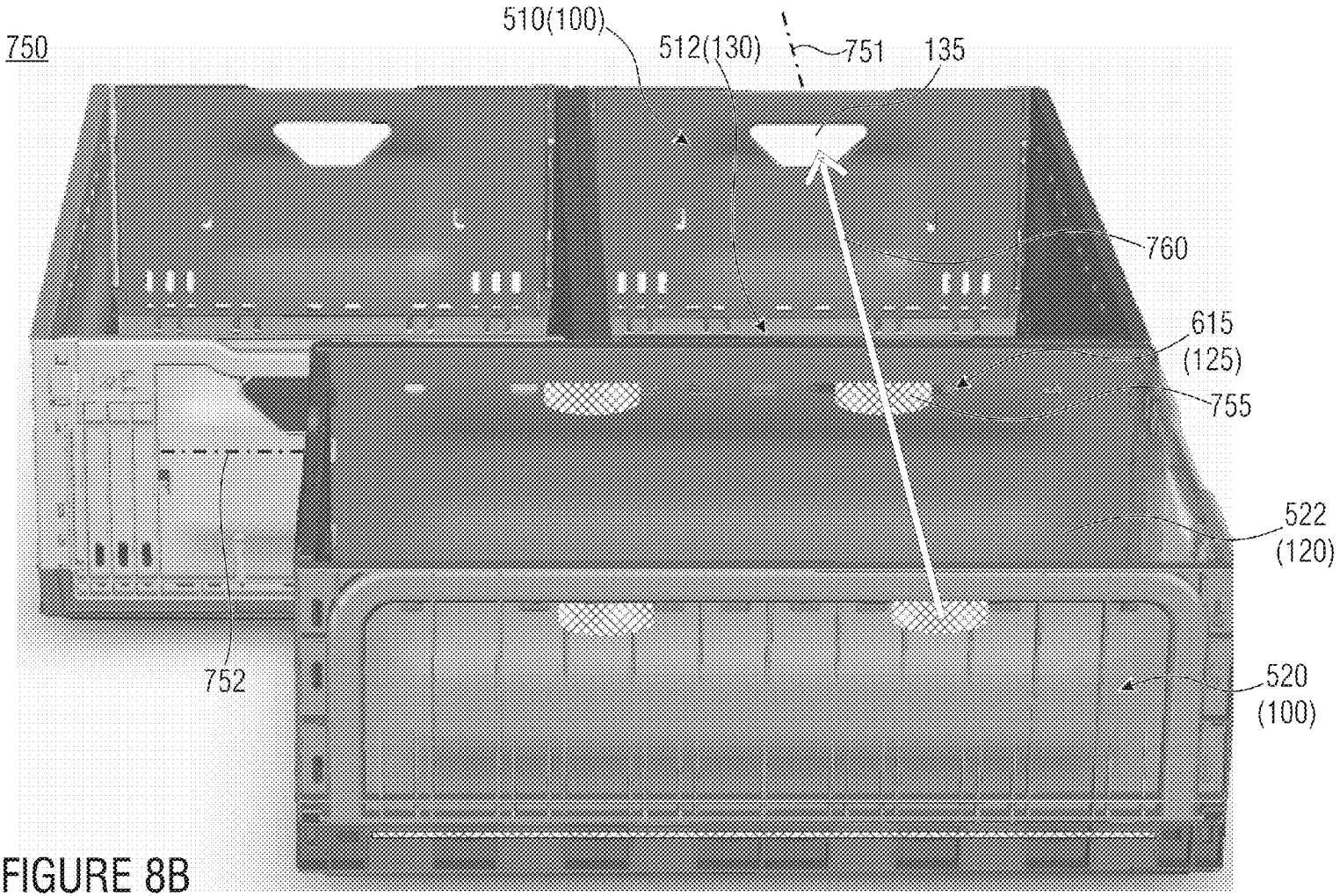
FIG. 8*c* shows a side view of an end wall of a crate of the arrangement in accordance with FIGS. 8*a*; 8*b;*
FIG. 8*d* shows a side view of a side wall of a crate of the arrangement in accordance with FIGS. 8*a*; 8*b;*
FIG. 8*e* shows a top view of a crate of the arrangement in accordance with FIGS. 8*a*; 8*b;*

FIGS. 8*a*; 8*b* show a perspective view of an arrangement 700 of a plurality of crates of the embodiment described with respect to FIG. 6 in a partial five-down configuration. In this context, 'partial' means that only three instead of five crates 100 of the five-down configuration are shown. Referring to FIGS. 8*a* and 8*b*, the two specific crates 510, 520 are arranged such that the end wall 512 of the first crate 510 is adjacent to the side wall 522 of the second crate 520. Here, the first crate 510 is aligned along a first longitudinal axis 751, while the second crate 520 is aligned along a second longitudinal axis 752. As can be seen in FIGS. 8*a*; 8*b*, the first longitudinal axis 751 and the second longitudinal axis 752 are perpendicular to each other. Moreover, a side wall 770 of the first crate 510 and an end wall 780 of the second crate 520 are aligned to be flush in this partial five-down configuration. Correspondingly, the at least partial overlap of the grip hole 135 of the first crate 510 and the at least one vent hole 515 of the plurality 615 of vent holes of the second crate 520 may be provided, wherein the overlap region 765 is indicated by a dark mark. The thus obtained venting path 760, which is indicated by an arrow, shows a venting path for the air flow, thereby securing a proper ventilation of the respective interior of the crates 510, 520.

Figure 8C:
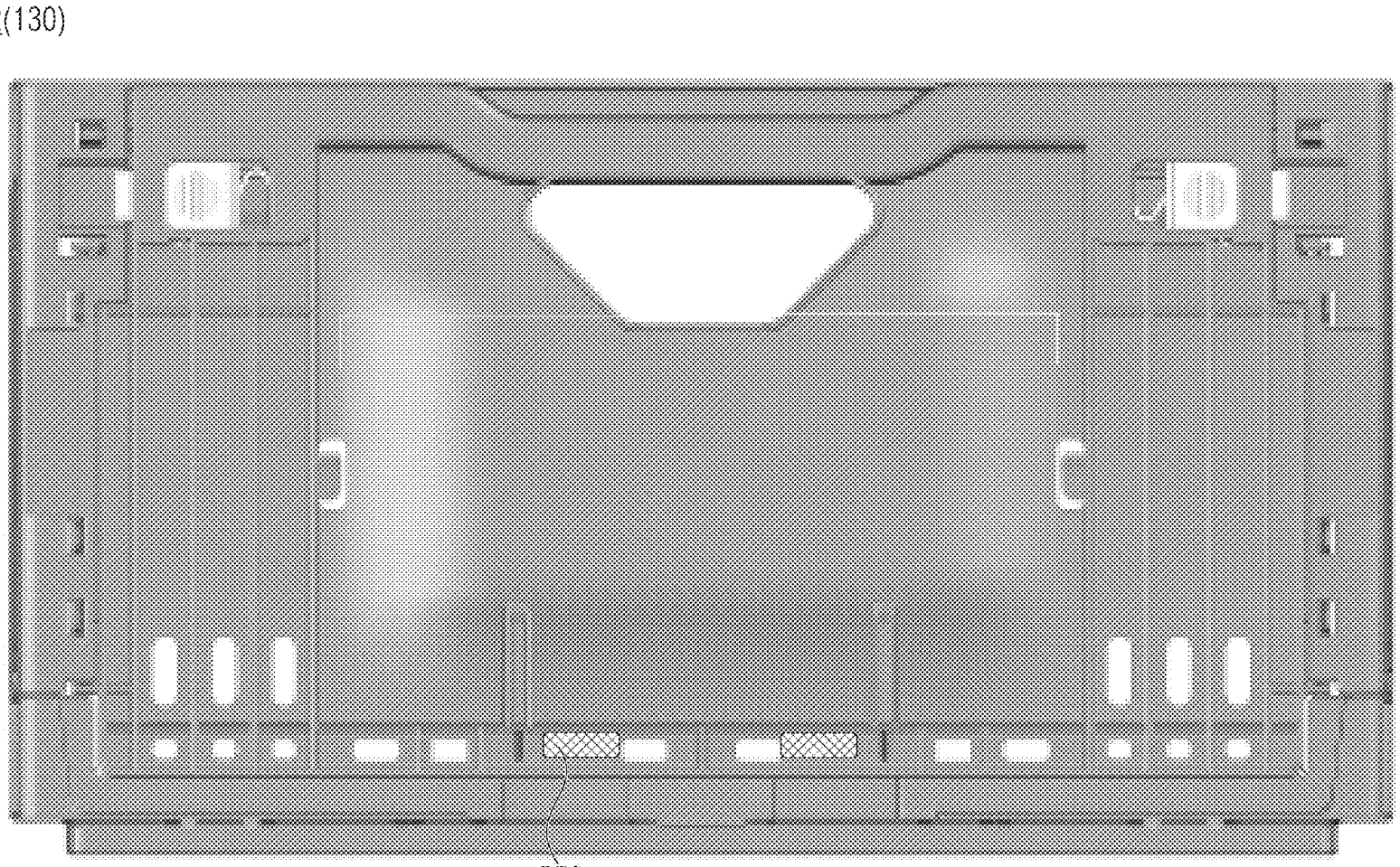
Figure 8D:
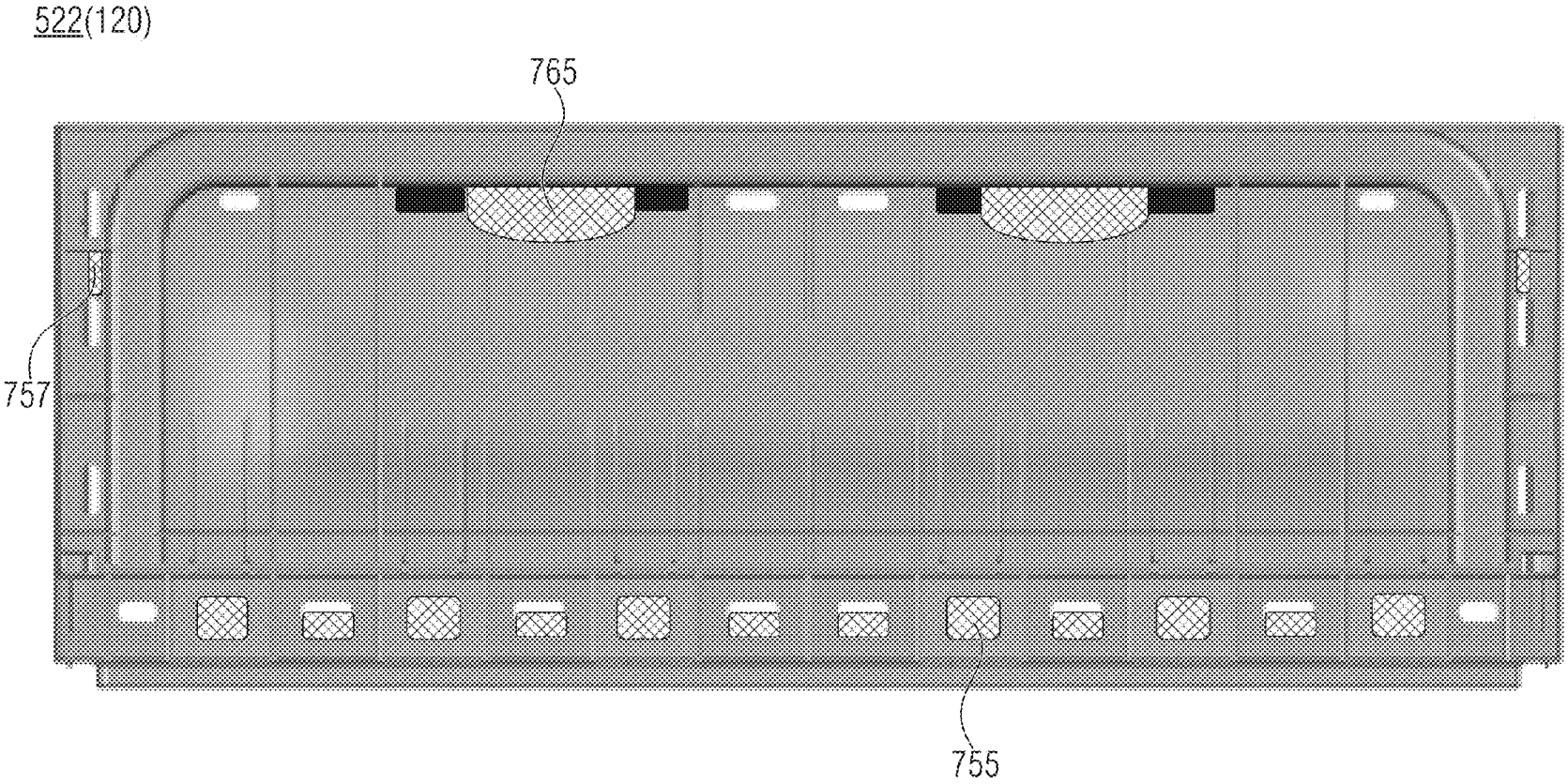
Figure 8E:
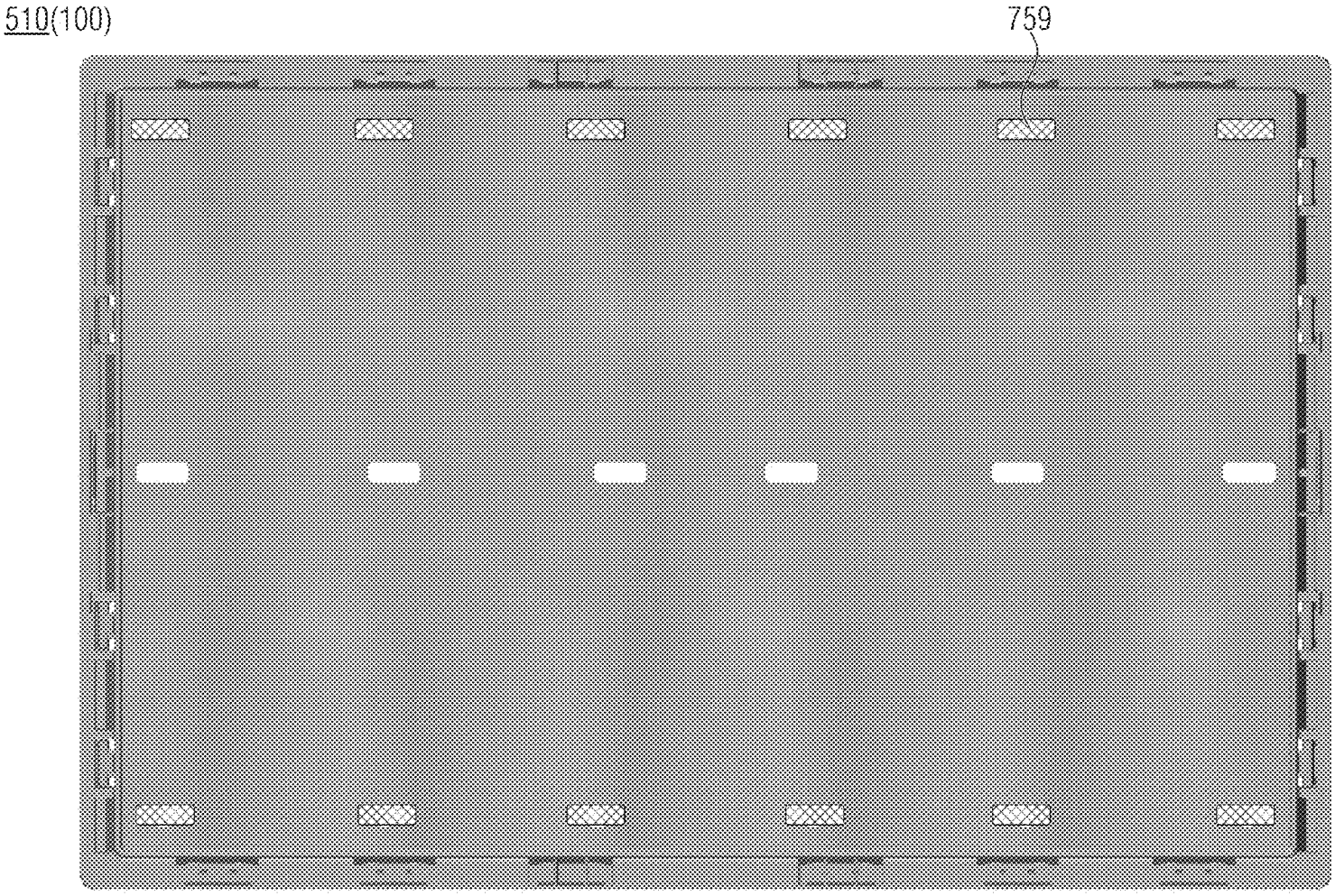

FIGS. 8*c*, 8*d* and 8*e* show different views of the end wall 512, the side wall 522 and the crate 510, respectively. Specifically, in the shown embodiments, further different formations of ventilation regions 755; 756; 759 in the lower part and/or close to a corner (region 757) of the crate 510 may be provided, eventually leading to better ventilation properties.

Inner Surface of the Crate ($2^{nd}$ Aspect)

A second aspect of the present invention addresses the further disadvantage that the inner surfaces of the side walls of known crates are straight and not free of sharp and/or hard objects.

Figure 9:
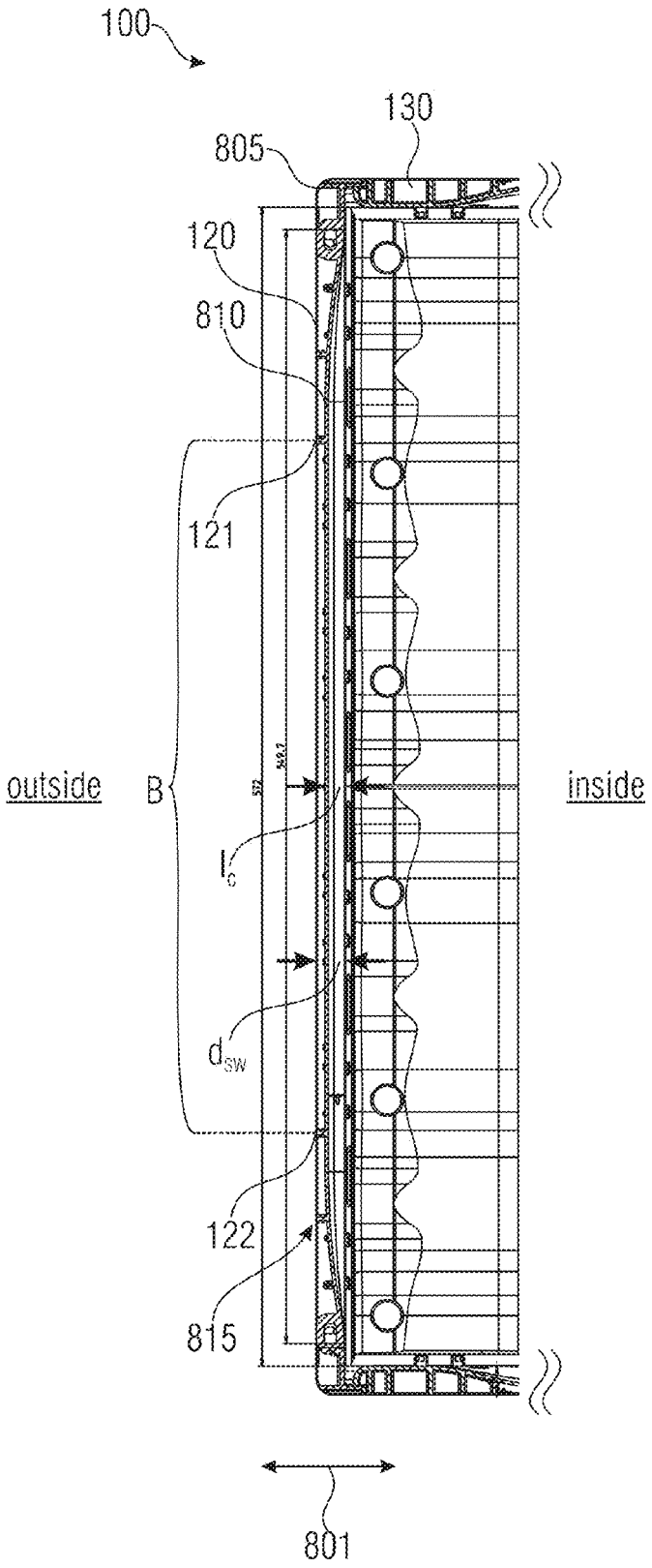
FIG. 9 shows a detailed top view of a side wall of a further embodiment of a crate with a convex-shaped smooth inner surface.

FIG. 9 shows a top view of the side wall 120 of the crate 100 in more detail. It can be seen in FIG. 9 that the side wall 120 comprises stiffening members 815 including the stiffening members 121, 122, which were also shown in FIG. 1. The side wall 120 may comprise a smooth inner surface 810 being shaped in a convex form towards the outside of the crate 100. In addition, the stiffening members 815 may be provided on the outer surface of the side wall 120 only. In order to provide the smooth inner surface 810, the crate 100 or at least the side wall 120 can be made of plastic. It can be seen in FIG. 9 that the convex-shaped smooth inner surface 810 has a lateral curvature dimension $l_c$ less than a maximum lateral dimension $d_{SW}$ of the side wall 120. Here, the lateral dimension is defined as the dimension in a lateral direction 801 perpendicular to the side wall 120. The inner surface 810 is substantially curved in a region B of the side wall 120 only. With regard to FIG. 3, this region B is defined as a region, where the non-continuous stiffening members 123 extending along the vertical direction 301 are interrupted. The region B is therefore a central region, which is not close to a corner 805 of the crate 100, and which is essentially bordered by the continuous stiffening members 121, 122. The advantage of using the convex-shaped inner surface 810 is that on the one hand, the crate 100 will especially be suitable for accommodating products with rounded surface portions. On the other hand, since the inner surface 810 can be made very smooth, i.e. without sharp edges or corners, the risk of damaging or crushing the transportable products during their transport may be minimized.

Quick Access to the Crate Interior ($3^{rd}$ Aspect)

A third aspect of the present invention addresses the further disadvantage regarding the lack of possibility of quick and easy access to the inside of a specific crate, when the same is, for example, stacked into a column onto a pallet.

Figure 10:
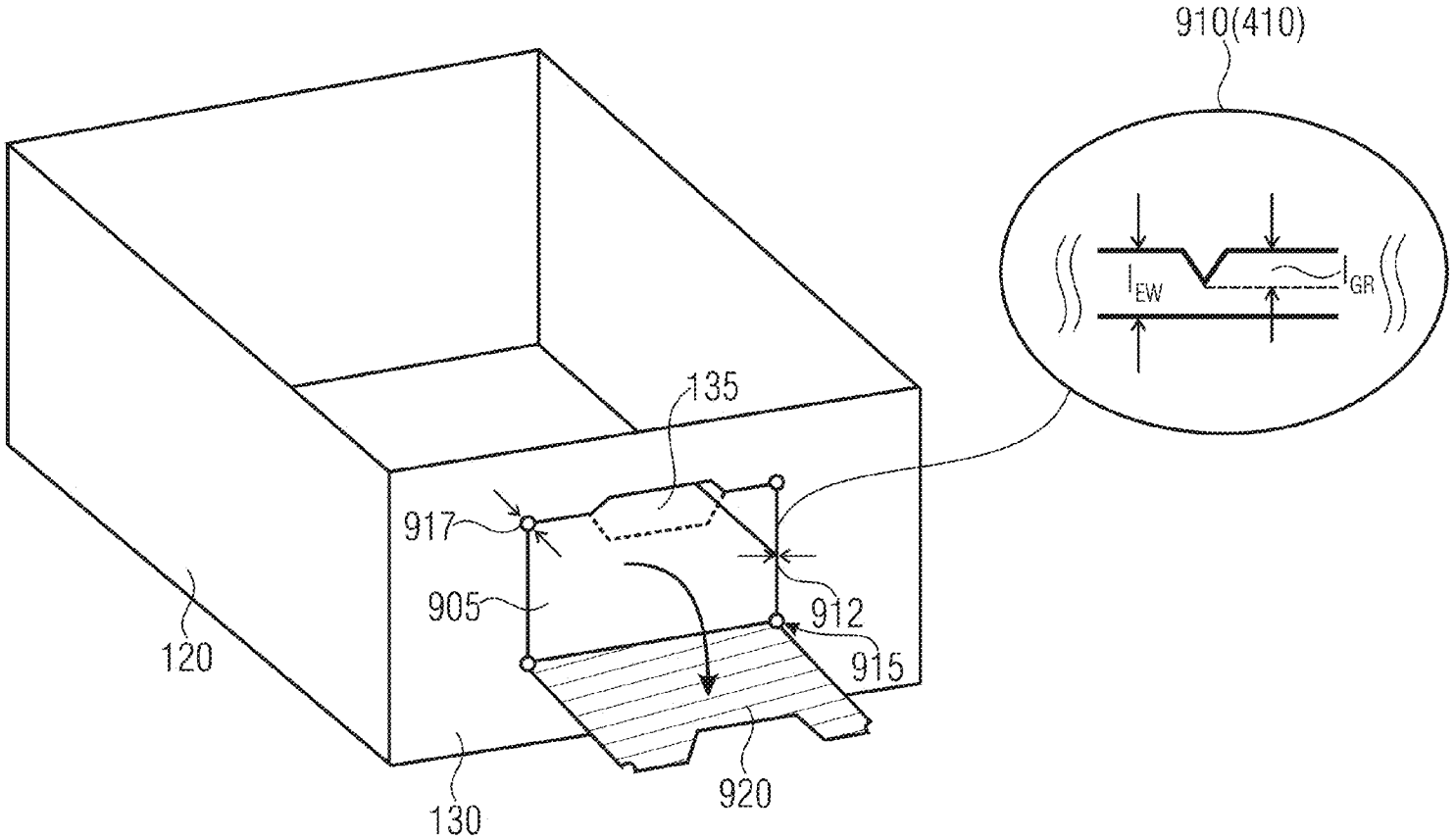
FIG. 10 shows a perspective view of a further embodiment of a crate with an openable portion.

FIG. 10 shows a perspective view of a further embodiment of a crate 100 with an openable portion. In the FIG. 10 embodiment, the end wall 130 comprises a thinned portion 910, which may correspond to the thinned portion 410 shown in FIG. 4, wherein the thinned portion 910 may be configured as a groove. This groove 910 is made in the end wall 130 and surrounds at least three sides of a predefined area 905. As can be seen in the FIG. 10 embodiment, the predefined area 905 is substantially rectangular. The zoom view shows that the groove 910 comprises a thickness $l_{GR}$ in a direction perpendicular to the end wall 130, which is more than half of the thickness $l_{EW}$ of the end wall 130. This characteristic of the groove 910 allows for an easy cutting thereof. Furthermore, along the groove 910, a plurality 915 of holes may be arranged, wherein each hole may have a diameter 917 larger than a width 912 of the groove 910. The width 912 may typically be equal or larger than 6 mm (see also FIG. 4). The dimensioning of the holes 915 is therefore such that a knife, which is commonly used by a controller, can be easily introduced into them and then cut along the groove 910. By cutting the groove 910, an openable portion 920 may be provided, which is essentially attached to the end wall 130. The openable portion 920 can be unfolded as indicated by the arrow. The purpose of providing such an openable portion is that the user can take a look inside the interior of the crate 100 for inspecting the accommodated products. For example, it can be checked whether carried fruits such as bananas have already reached a certain degree of ripeness. Again, the end wall 130 may be made of plastic, such that a normal knife can be used by the controller. The FIG. 10 embodiment shows also that the predefined area 905 may be more than one third of an area of the end wall 130 so as to provide a large enough inspection opening. In embodiments, where two or more crates 100 are stacked adjacent to each other, such as in the five-down configuration partially shown in FIGS. 7*a*; 7*b*, 8*a*, 8*b*, they should be arranged such that the groove 910 of at least one end wall 130 may be accessible by a user.

Arch-Shaped Crate Bottom ($4^{th}$ Aspect)

A fourth aspect of the present invention addresses the further disadvantage that products protruding from a lower crate may be damaged by a load of an upper crate, when the upper crate is stacked on top of the lower crate.

Figure 11A:
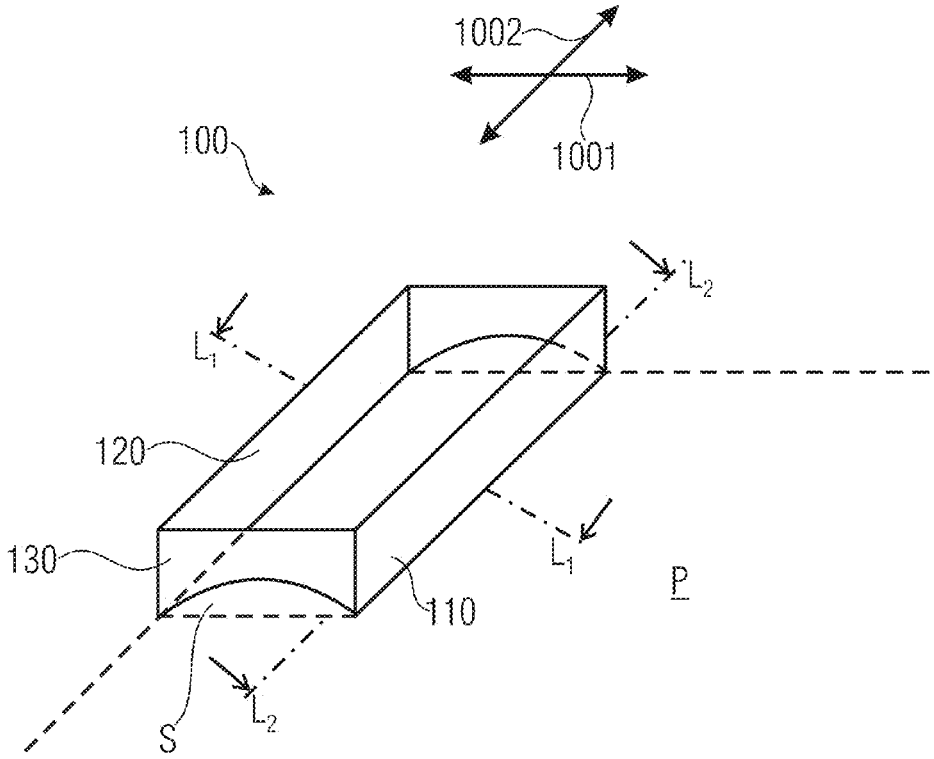
FIG. 11*a* shows a perspective view of a further embodiment of a crate with an arch-shaped bottom.
Figure 11B:
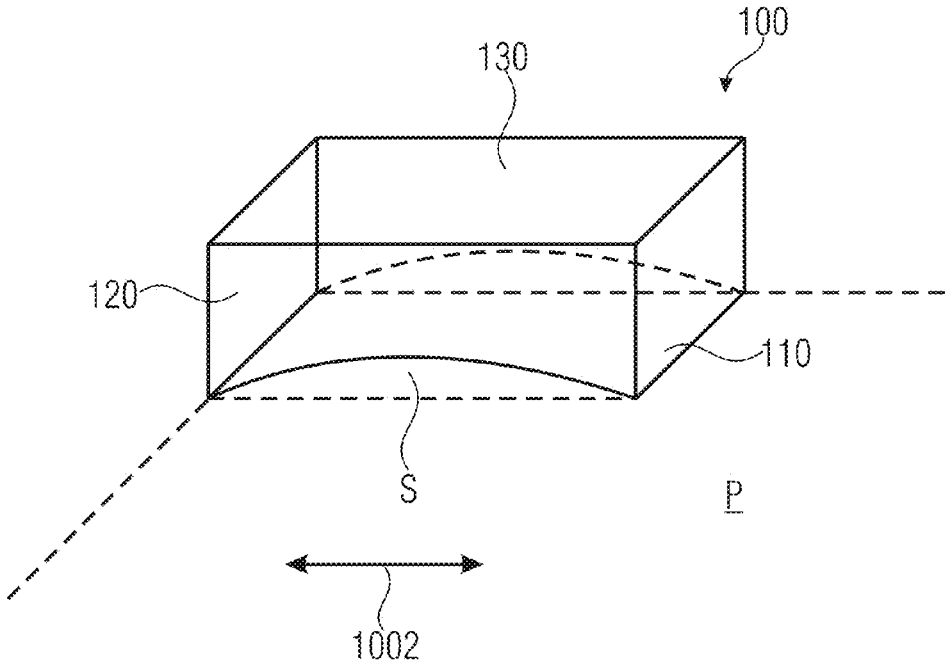
FIG. 11*b* shows a perspective view of a further embodiment of the crate in accordance with FIG. 11*a;*

FIGS. 11*a*, 11*b* show perspective views of further embodiments of a crate 100, wherein the bottom 110 is particularly arch-shaped curving towards the interior of the crate 100. The bottom 110 may either be curved along a direction 1001 of the end wall 130 (see FIG. 11*a*) or along a direction 1002 of the side wall 120 (see FIG. 11*b*). As can be clearly seen in the FIGS. 11*a*, 11*b*, both designs provide an additional space S between a lower surface of a bottom 110 and a plane P. Here, the plane P is defined by a lower end of the crate 100, respectively.

Figure 12A:
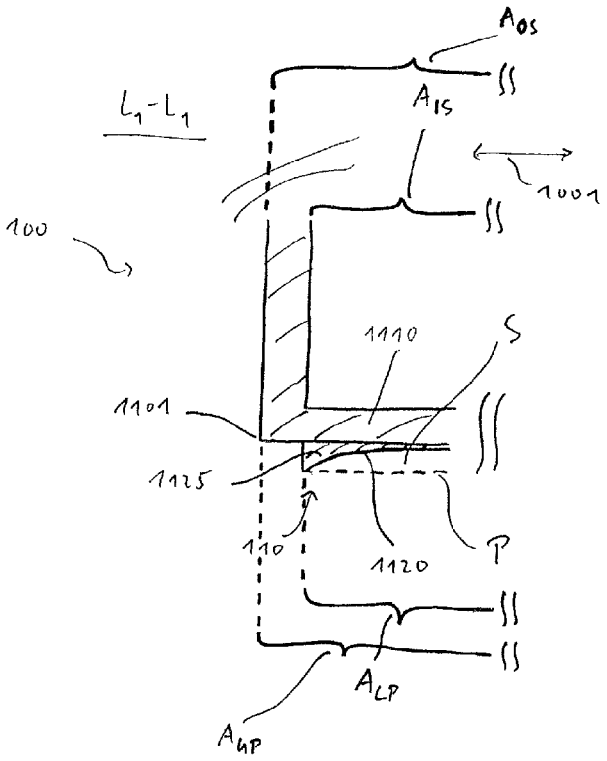
FIGS. 12*a*, 12*b* illustrates details of the bottom of the embodiment of the crate in accordance with FIGS. 11*a*; 11*b;*
Figure 12B:
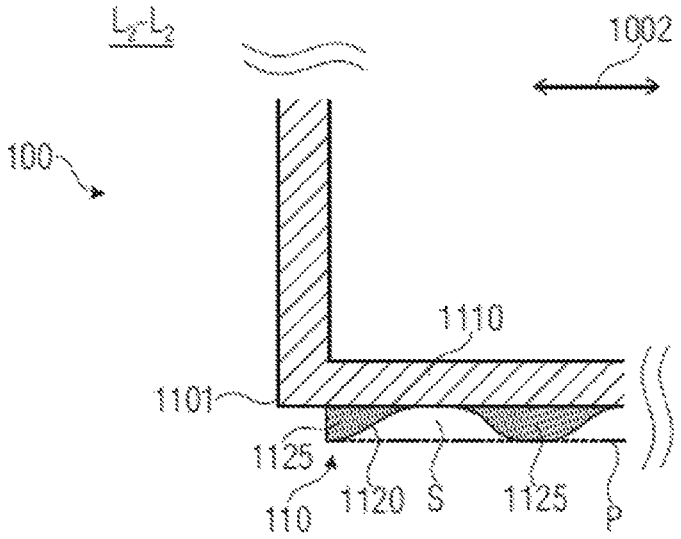

FIGS. 12*a*, 12*b* show more details of the bottom 110 of further embodiments of the crate 100 in accordance with FIGS. 11*a*, 11*b*. In particular, FIG. 12*a* is a partial section view along a line $L_1$-$L_1$ of FIG. 11*a*, while FIG. 12*b* is a partial section view along a line $L_2$-$L_2$ of FIG. 11*a*. In both FIG. 12*a* and FIG. 12*b*, the bottom 110 comprises an upper portion 1110 and a lower portion 1120, wherein the lower portion 1120 may be recessed with respect to an outer point 1101 of the walls of the crate 100. As can be clearly seen in the section view of FIG. 12*a*, the lower portion 1120 of the bottom 110 may be curved upwards along the direction 1001, such that a bulge 1125 will be obtained. The additional space S that is created is depicted in FIG. 12*a* as a gradual increase of a cross-sectional area to the right.

The partial section view of FIG. 12*b* shows that the bottom 110 may have a wave like shape along the direction 1002 in the vicinity of the side wall 120. Note that $L_2$-$L_2$ is taken at a border region of the crate 100, as shown in FIG. 11*a*. In particular, the wave like shape of the bottom 110 causes bulges 1125 to be located along the direction 1002, i.e. along the end wall 120, which makes the bottom 110 very rigid.

In further embodiments, starting from a central longitudinal axis of a crate 100, the curvature of the bulges 1125 may also become gradually more pronounced in the direction 1001 (i.e. in a direction closer to the side wall 120).

In further embodiments, a first portion of the wavy-shaped bottom 110 is at a height of the plane P, while a second portion of the wavy-shaped bottom 110 is maximally at a height of a lower end of the upper portion 1110 corresponding to a maximum extent of the wave like shape.

Figure 13A:
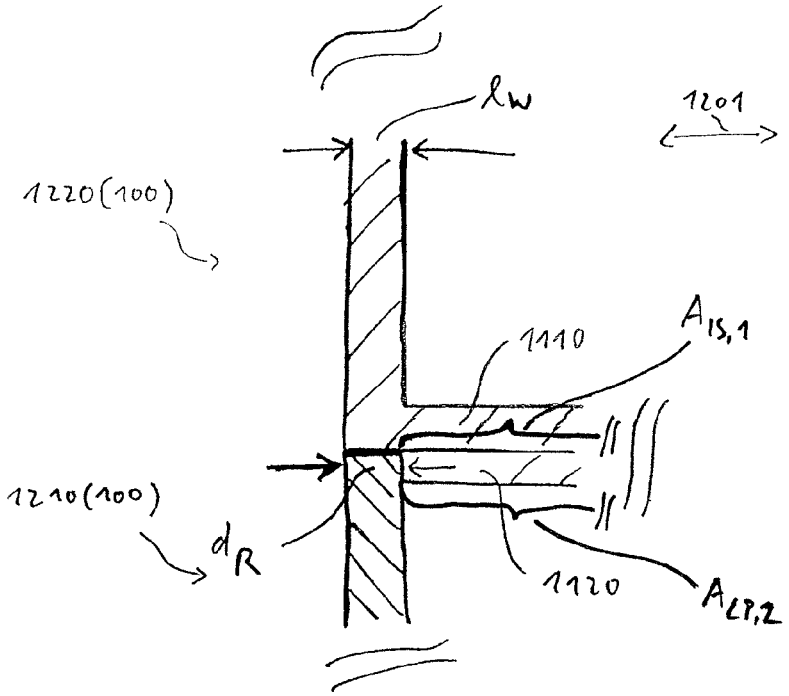
FIG. 13*a* shows a partial side view of an embodiment of a stack of two crates stacked on top of each other.
Figure 13B:
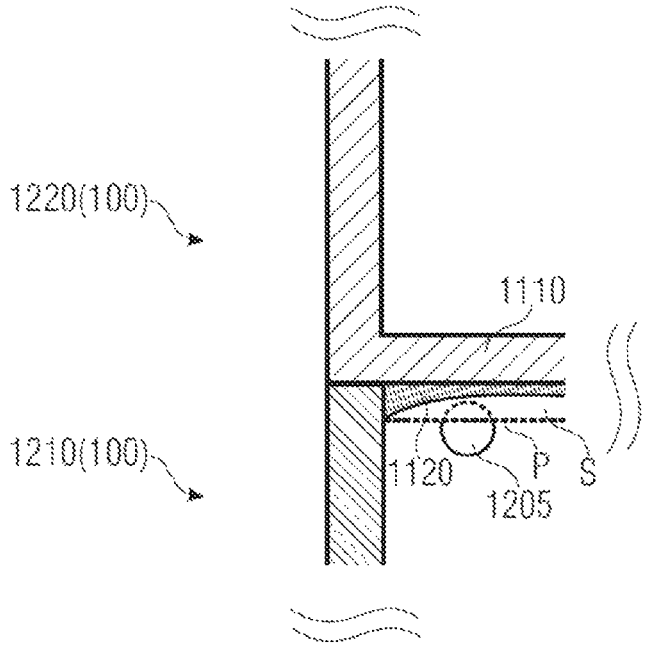
FIG. 13*b* shows a partial side view of a further embodiment of the stack in accordance with FIG. 13*a* with a space (S) between the two crates.

FIGS. 13*a*, 13*b* show side views of further embodiments, wherein, for example, two crates 1210, 1220 are stacked on top of each other. Both in the FIG. 12 and FIG. 13 embodiments, a distance $d_R$ of the recess may be chosen such that it will be equal to a thickness $l_W$ of the walls. In this way, an engagement of the lower portion 1120 of the second crate 1220 and a top opening of the first crate 1210 may be achieved, therefore preventing a lateral movement in a direction 1201 shown in FIG. 13*a*.

In further embodiments, the lower portion 1120 has an area $A_{LP}$ defined by an outer perimeter of the lower portion 1120, while the upper portion 1110 has an area $A_{UP}$ defined by an outer perimeter of the upper portion 1110. Moreover, an inner area $A_{IS}$ may be defined by the inner surfaces of the walls at an upper end of the crate 100, while an outer area $A_{OS}$ may be defined by the outer surfaces of the walls at the upper end of the crate 100. In particular, the area $A_{LP}$ approximately equals the area $A_{IS}$, while the area $A_{UP}$ approximately equals the area $A_{OS}$.

In further embodiments, an inner area $A_{IS,1}$ defined by the inner surfaces at an upper end of the first crate 1210 and an area $A_{LP,2}$ defined by an outer perimeter of the lower portion 1120 of the second crate 1220 may be equal, such that the first crate 1210 and the second crate 1220 fit accurately together, when the second crate 1220 is stacked on top of the first crate 1210.

In further embodiments, the bottom 110 of the second crate 1220 may also comprise a plurality of vent openings so as to provide a venting path between the first crate 1210 and the second crate 1220.

Referring to FIG. 13*b*, the advantage of providing the additional space S is that in practice, when two or more crates are stacked on top of each other into a column onto a pallet, products 1205 extending beyond an upper end of the lower crate 1210 of the column, such as the curved portions of a banana protruding the plane P, may be efficiently protected from being squeezed by heavy load of the upper crate 1220 of the column.

In summary, embodiments of the present invention provide a crate such as a banana crate, wherein the design of the vent holes of the crate allows for proper venting of the interior of the crate even in case same is stacked such that two crates are arranged such the end wall of one crate is adjacent to a side wall of another crate (e.g. a five-down configuration). Specifically, by providing a venting path, a uniform air distribution and therefore a consistent temperature control for fruit quality may be achieved with such a design.

Here, the arrangement of the vent holes in the side walls is to be such that at least one vent hole is to be provided in the side wall at a distance from each corner, the distance being equal to the distance the grip hole in the end wall is away from the same corner, thereby ensuring at least a partial overlap of the grip hole and at least one vent hole in case of stacking the plurality of crates as mentioned above. In accordance with further embodiments pairs of vent holes may be provided that together may have a shape similar to the grip hole. Also, a plurality of vent holes being equally spaced may be provided with a spacing being less than the dimension of the grip hole.

A further aspect of embodiments is the smooth inside surface thereof being shaped in convex form towards the outside and therefore products with rounded surfaces, like bananas, are more easily accommodated at the side portions of the crate by providing the convex or curved inner surface. This may apply for both the side walls and for the end walls. In accordance with further embodiments, stiffening members like ribs and the likes are provided only on the outside of the crate.

Yet another feature of embodiments is the provision of a thinned portion in the end walls allowing a cutting thereof to provide for an opening, allowing a user of the crate to take a look into the interior of the crate, which is important for determining for a complete batch of crates whether the product inside the crate, for example bananas, already reached a desired degree of ripeness.

The fourth feature concerns the bottom which is arch-shaped. This does not have any direct impact on the products inside the crate, but upon stacking a plurality of crates on top of each other. This allows for provided additional space in a crate below, thereby avoiding damaging product which slightly stick out beyond the upper end of the lower crate. The arch- and wavy-shaped bottom allows accommodating such products slightly sticking out in the crate below.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

The invention claimed is:

1. A crate comprising a bottom including an upper portion and a lower portion, and two respective pairwise opposing side walls and end walls, wherein:

the upper portion of the bottom is flat and the lower portion of the bottom is arch-shaped curving towards the interior of the crate, such that a space between a lower surface of the bottom and a plane defined by a lower end of the crate is provided, when the crate is loaded with a load, the bottom is arch-shaped along a direction of an end wall of the crate, the arch shape of the bottom extends between the opposing side walls, the bottom has a wavy-shape along a direction of the opposing side walls of the crate in border regions of the opposing side walls, first portions of the wavy shape define a plurality of opposing bulges at a height of the plane, and second portions of the wavy shape define a maximum height of the wavy shape corresponding to a height of a lower end of the upper portion of the bottom, the lower portion of the bottom extending between the plurality of opposing bulges is arch-shaped, the bottom includes a plurality of rectangular vent openings arranged along a central longitudinal axis, the central longitudinal axis being parallel to the side walls, and the plurality of rectangular vent openings extends along the central longitudinal axis into a central region of the bottom.

2. The crate according to claim 1, wherein the upper portion of the bottom and the lower portion of the bottom are recessed with respect to the outer point of the walls, wherein a distance of the recess is equal to a thickness of the walls, allowing for engagement of the lower portion of the bottom with a top opening of a further crate.

3. The crate according to claim 1, wherein the lower portion of the bottom has a first area defined by an outer perimeter of the lower portion of the bottom, and wherein the upper portion of the bottom has a second area defined by an outer perimeter of the upper portion of the bottom, the side walls and end walls comprising inner surfaces and outer surfaces, wherein an inner area is defined by the inner surfaces at a upper end of the crate, and wherein an outer area is defined by the outer surfaces at the upper end of the crate, wherein the first area approximately equals the inner area and the second area approximately equals the outer area.

4. A stack of two crates according to claim 1, wherein a first crate and a second crate are configured to provide an inner area defined by the inner surfaces at an upper end of the first crate and a first area defined by an outer perimeter of the lower portion of the bottom of the second crate, wherein the inner area and the first area are equal, such that the movement between the first crate and the second crate is prevented, when the second crate is stacked on top of the first crate.

5. The stack according to claim 4, wherein the bottom of the second crate comprises a plurality of vent openings being configured to provide a venting path between the first crate and the second crate.

* * * * *